US009193560B2

(12) United States Patent
Hamada et al.

(10) Patent No.: US 9,193,560 B2
(45) Date of Patent: Nov. 24, 2015

(54) LEADER MEMBER, SUBSTRATE, SUBSTRATE CARTRIDGE, SUBSTRATE-PROCESSING APPARATUS, LEADER-CONNECTING METHOD, METHOD OF MANUFACTURING DISPLAY ELEMENT, AND APPARATUS FOR MANUFACTURING DISPLAY ELEMENT

(75) Inventors: Tomohide Hamada, Yokohama (JP); Tohru Kiuchi, Higashikurume (JP)

(73) Assignee: NIKON CORPORATION, Tokyo (JP)

( * ) Notice: Subject to any disclaimer, the term of this patent is extended or adjusted under 35 U.S.C. 154(b) by 797 days.

(21) Appl. No.: 13/475,368

(22) Filed: May 18, 2012

(65) Prior Publication Data

US 2012/0231694 A1 Sep. 13, 2012

Related U.S. Application Data

(63) Continuation of application No. PCT/JP2010/070544, filed on Nov. 18, 2010.

(30) Foreign Application Priority Data

Nov. 19, 2009 (JP) ..... P2009-263752

(51) Int. Cl.
*B65H 75/28* (2006.01)

(52) U.S. Cl.
CPC ..... *B65H 75/28* (2013.01); *B65H 2701/124* (2013.01)

(58) Field of Classification Search
CPC ..... B65H 75/28
See application file for complete search history.

(56) References Cited

U.S. PATENT DOCUMENTS

| | | | | |
|---|---|---|---|---|
| 5,765,062 | A * | 6/1998 | Dobbs et al. | 396/322 |
| 2006/0207916 | A1 | 9/2006 | Mimura et al. | |
| 2008/0213621 | A1* | 9/2008 | Takashima et al. | 428/690 |

FOREIGN PATENT DOCUMENTS

| | | | |
|---|---|---|---|
| CN | 1676659 | A | 10/2005 |
| JP | 02-7386 | | 1/1990 |
| JP | H07-172017 | | 7/1995 |
| JP | 10-177210 | | 6/1998 |
| JP | H11-119292 | | 4/1999 |
| JP | 2003-142897 | | 5/2003 |
| JP | 2005-285576 | | 10/2005 |
| JP | 2009-093848 | | 4/2009 |
| JP | 2009-231169 | | 10/2009 |
| TW | 200417501 | A | 9/2004 |
| WO | WO 2006/100868 | A1 | 9/2006 |

OTHER PUBLICATIONS

Notice of Reasons for Rejection issued by the Japanese Patent Office in counterpart Japanese Application No. 2011-541944, mailed Aug. 12, 2014, 6 pages.

Notification of the First Office Action issued by the State Intellectual Property Office of People's Republic of China, in Chinese Patent Application No. 201080049274.X, Issue Date: May 27, 2014 (28 pages).

(Continued)

*Primary Examiner* — Mary Ellen Bowman
(74) *Attorney, Agent, or Firm* — Finnegan, Henderson, Farabow, Garrett & Dunner, L.L.P.

(57) ABSTRACT

A leader member includes a connection portion that is connected to a substrate and a position reference portion that is used at least for aligning the substrate with the connection portion.

26 Claims, 23 Drawing Sheets

(56) References Cited

OTHER PUBLICATIONS

International Search Report from the Japanese Patent Office for International Application No. PCT/JP2010/070544, mailing date Mar. 1, 2011.

Written Opinion of the International Searching Authority from the Japanese Patent Office for International Application PCT/JP2010/070544, mailing date Mar. 1, 2011.

Taiwanese Office Action of Application No. 099139640 mailed Apr. 20, 2015 (13 pages).

* cited by examiner

LEADER MEMBER, SUBSTRATE, SUBSTRATE CARTRIDGE, SUBSTRATE-PROCESSING APPARATUS, LEADER-CONNECTING METHOD, METHOD OF MANUFACTURING DISPLAY ELEMENT, AND APPARATUS FOR MANUFACTURING DISPLAY ELEMENT

CROSS-REFERENCE TO RELATED APPLICATION

This is a Continuation Application of International Application No. PCT/JP2010/070544, filed Nov. 18, 2010, which claims priority to Japanese Patent Application No. 2009-263752, filed on Nov. 19, 2009. The contents of the aforementioned applications are incorporated herein by reference.

BACKGROUND

1. Field of the Invention

The present invention relates to a leader member, a substrate, a substrate cartridge, a substrate-processing apparatus, a leader-connecting method, a method of manufacturing a display element, and an apparatus for manufacturing a display element.

2. Description of Related Art

As display elements configuring display devices such as display apparatuses, for example, organic electroluminescence (organic EL) elements are known. The organic EL element has a configuration in which an anode and a cathode are formed on a substrate, and an organic light-emitting layer interposed between the anode and the cathode is included. In the organic EL element, holes are injected to the organic light-emitting layer from the anode, holes and electrons are combined together in the organic light-emitting layer, and display light is acquired in accordance with emitted light at the time of the combing thereof. In the organic EL element, for example, an electric circuit connected to the anode and the cathode and the like are formed on the substrate.

As one of techniques for manufacturing an organic EL element, for example, a technique called a roll-to-roll method (hereinafter, simply referred to as a "roll method") is known (for example, see PCT Publication No. 2006/100868). The roll method is a technique in which one sheet-shaped substrate wound around a roller located on the substrate supplying side is sent out, the substrate is conveyed while the sent substrate is wound around a roller located on the substrate recovering side, and a light-emitting layer, an anode, a cathode, an electric circuit, and the like that configures an organic EL element are sequentially formed on the substrate until the substrate is wound after being sent off.

In the configuration disclosed in PCT Publication No. 2006/100868, for example, a roller used for sending out the substrate and a roller used for winding the substrate are configured so as to be detachable from a manufacturing line. The detached rollers, for example, are conveyed to another manufacturing line and can be installed to another manufacturing line so as to be used. In such a configuration, the transmission and the reception of the substrate between the rollers and the manufacturing line and the transmission and the reception of the substrate within the manufacturing line are frequently performed.

SUMMARY

However, in the above-described configuration, for example, countermeasures are not set in the conveyance between the rollers and the manufacturing line, the conveyance within the manufacturing line, and the like, and there is a possibility of the occurrence of a problem from the viewpoint of the precision of the conveyance of a substrate.

The object of the aspects of the present invention is to improve the precision of the conveyance of a substrate.

According to a first aspect of the present invention, there is provided a leader member including: a connection portion that is connected to a substrate; and a position reference portion that is used at least for aligning the substrate with the connection portion.

According to a second aspect of the invention, there is provided a substrate including: a substrate main body that is conveyed in a predetermined direction; and a leader that is connected to an end portion of the substrate main body, wherein the leader member according to the present invention is used as the leader.

According to a third aspect of the invention, there is provided a substrate cartridge including a cartridge main body that houses a substrate, wherein the substrate according to the present invention is housed as the substrate.

According to a fourth aspect of the invention, there is provided a substrate-processing apparatus including: a substrate-processing unit that processes a substrate; a substrate carrying-in unit that carries the substrate in the substrate-processing unit; and a substrate carrying-out unit that carries out the substrate from the substrate-processing unit, wherein the substrate cartridge according to the present invention is used as at least one of the substrate carrying-in unit and the substrate carrying-out unit.

According to a fifth aspect of the invention, there is provided a leader-connecting method for connecting a leader member to a substrate, the leader-connecting method including: aligning the substrate with the leader member; and connecting the substrate and the leader member to each other after the alignment of the substrate and the leader member.

According to a sixth aspect of the invention, there is provided a method of manufacturing a display element, the method including: processing the substrate by using the substrate-processing unit; and conveying a substrate to the substrate-processing unit by using the leader member according to the present invention.

According to a seventh aspect of the invention, there is provided an apparatus for manufacturing a display element, the apparatus including: a conveying unit that conveys the leader member according to the present invention that is connected to a substrate; and a substrate-processing unit that processes the substrate.

According to the aspects of the present invention, the precision of the conveyance of a substrate can be improved.

DESCRIPTION OF EMBODIMENTS

First Embodiment

Hereinafter, a first embodiment of the present invention will be described with reference to the drawings.

(Film Substrate and Leader Member)

Figure 1:
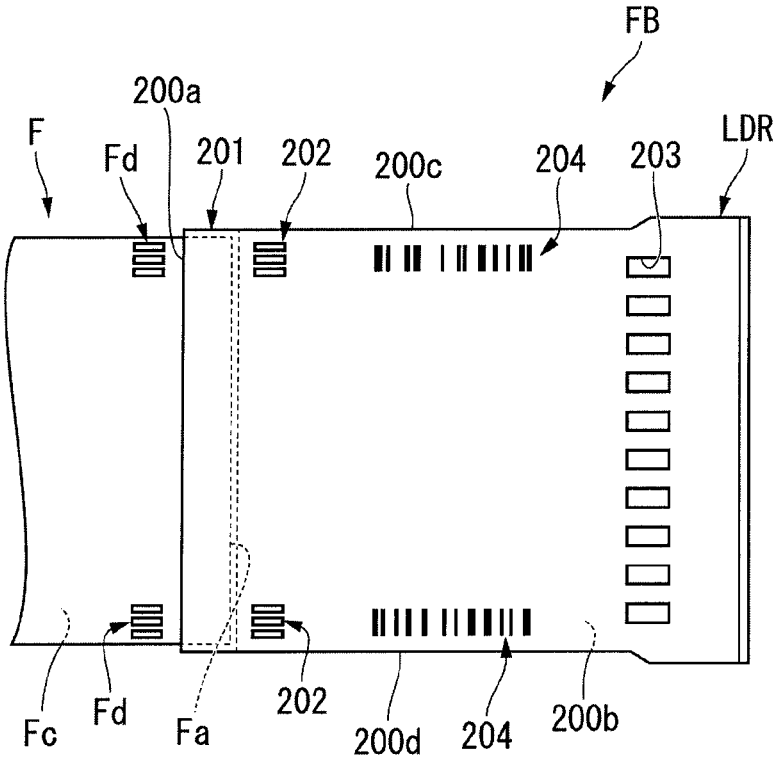
FIG. 1 is a plan view illustrating the configuration of a leader member according to an embodiment of the present invention.

FIG. 1 is a plan view illustrating the configuration of a film substrate FB. FIG. 1 is a diagram illustrating the planar configuration of the film substrate FB, and FIG. 2 is a diagram illustrating the cross-sectional configuration of the film substrate FB.

Figure 2:
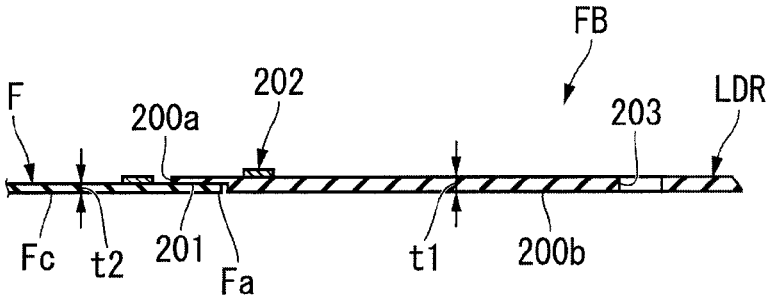
FIG. 2 is a cross-sectional view illustrating the leader member according to the embodiment.

As illustrated in FIGS. 1 and 2, the film substrate (substrate) FB includes a leader member (header member) LDR and a film (substrate main body) F, and a configuration is formed in which the leader member LDR and the film F are bound to each other so as to be connected.

The leader member LDR is a sheet-shaped member that is formed in an approximate rectangular shape in the plan view. As examples of a material configuring the leader member LDR, there are stainless steel, plastic, and the like. In an area of the leader member LDR along one side (a left side in the FIG. 200*a*, a stair portion 201 is formed. The stair portion 201, for example, is formed on one face (the lower face in FIG. 2) 200*b* of the leader member LDR. A portion of the leader member LDR in which the stair portion 201 is formed is thinner than the other portions.

The film substrate FB has a configuration in which the stair portion 201 of the leader member LDR is bonded to an end portion Fa of the film F through thermal welding or an adhesive. As above, the stair portion 201 of the leader member LDR is used as a connection portion that is connected to the film F having flexibility. The leader member LDR is bonded to slightly protrude from the film F in the extending direction of the side 200*a*. Accordingly, in the extending direction of the side 200*a*, the entire end portion of the film F is covered with the leader member LDR.

In this embodiment, as an example of the film F of the connection destination of the leader member LDR, there is a band-shaped film that has flexibility and is used by being wound in a roll shape, and the like. As the composition material of the film, for example, a film having heat resistance, stainless steel, or the like can be used. For example, as the material of the resin film, polyethylene resin, polypropylene resin, polyester resin, ethylene vinyl copolymer resin, polyvinylchloride resin, cellulosic resin, polyamide resin, polyimide resin, polycarbonate resin, polystyrene resin, polyvinyl acetate resin, or the like can be used. For example, the size of the film F on the shorter side direction (the vertical direction in FIG. 1) is formed to be about 1 m to 2 m, and the size thereof in the longitudinal direction (the horizontal direction in FIG. 1) is formed to be 10 m or more. In FIGS. 1 and 2, although a configuration is illustrated in which the leader member LDR is connected to one end of the film F in the longitudinal direction, in this embodiment, actually, a configuration is formed in which the leader member LDR is connected to both ends of the film F in the longitudinal direction. Here, the above-described sizes are merely examples, and the present invention is not limited thereto. For example, the size of the film substrate (sheet substrate) FB in the Y direction may be equal to or less than 50 cm or may be equal to or more than 2 m. In addition, the size of the film substrate (sheet substrate) FB in the X direction may be equal to or less than 10 m. In this embodiment, the flexibility represents a property of no shearing or no fracturing, for example, in a case where a predetermined force that is about the same level as that of its own weight is applied to the substrate and capable of bending the substrate. In addition, the flexibility changes in accordance with the material, the size, the thickness of the substrate, the environment such as the temperature, or the like.

It is preferable that the film F have a low thermal expansion coefficient such that the size thereof does not change, for example, even when the film First and second stages receives heat of about 200° C. is received. For example, the thermal expansion coefficient may be lowered by mixing inorganic filler into the resin film. As examples of the inorganic filler, there are titanium oxide, zinc oxide, alumina, and silicon oxide.

The leader member LDR according to this embodiment is formed to have rigidity higher than the film F. As specific examples of such a configuration, there are a configuration in which the thickness of the leader member LDR is formed to be larger than that of the film F, a configuration in which a material having rigidity higher than that of the composition material of the film F is used as the composition material of the leader member LDR, and the like. In this embodiment, as illustrated in FIG. 2, the reader member LDR and the film F are formed such that the thickness t1 of the leader member LDR is larger than the thickness t2 of the film F.

By configuring the rigidity of the leader member LDR to be higher than that of the film F, for example, the end portion Fa of the film F is supported. Accordingly, in a case where the film F is handled such as the film F being conveyed, wound up, or sent out, the end portion Fa of the film F is protected from being bent, deformed, or the like.

As illustrated in FIG. 2, in the state in which the film F is attached to the stair portion 201, for example, the lower face (face Fc) of the film F and the lower face (face 200*b*) of the leader member LDR are substantially flush. In order to acquire such a configuration, it is preferable that, for example, the thickness (in a case where an adhesive is used, the thickness of the adhesive is added) t2 be acquired in advance, and the stair portion 201 be formed such that the thickness t2 and the height of the stair portion 201 be the same. In the configuration in which the leader member LDR and the film F form are substantially flush, as in this embodiment, for example, in a case where the film substrate FB is placed in a flat target, the film substrate is placed without any gap.

As illustrated in FIG. 1, in a portion of the leader member LDR that is located near the stair portion 201, a position reference portion 202 that is a reference for the position alignment with the film F is disposed. The position reference portion 202, in the embodiment, is formed, for example, in a rectangular mark (three lines in the figure). Each position reference portion 202, for example, is disposed in the edge portion of each one of sides 200*c* and 200*d*, which face each other, of the leader member LDR.

With respect to the position reference portion 202, a film-side position reference portion Fd is formed on the film F. For example, the film-side position reference portion Fd is formed as the same mark (a mark of three lines) as that of the position reference portion 202. For example, each film-side position reference portion Fd is disposed in each of both end portions of the film F in the shorter side direction. The distance between the two film-side position reference portions Fd in the shorter side direction is the same as a distance between two position reference portions 202 in the same direction. In this embodiment, by aligning the position of the position reference portion 202 disposed in the leader member LDR with the position of the film-side position reference portion Fd disposed in the film F, the positions are matched between the leader member LDR and the film F. Accordingly, the position alignment with the leader member LDR and the film F can be performed with high precision.

For example, at positions deviated from the stair portion 201 in the plan view in the leader member LDR, a plurality of opening portions 203 is disposed. The plurality of opening portions 203 are arranged in the same direction as the extending direction of the side 200*a* on which the stair portion 201 is formed. The plurality of opening portions 203, for example, is arranged with a predetermined gap interposed therebetween. In each opening portion 203, for example, a portion such as a conveying member that maintains the leader member LDR is inserted into each opening portion so as to hang thereon. Accordingly, the leader member LDR can be conveyed in an easy manner. In addition, a configuration for easy conveying of the leader member LDR is not limited to the configuration in which the plurality of opening portions 203 is arranged but may be a configuration in which there is only one opening portion 203. In addition, the shape of the opening portion 203 is not limited to the rectangle as illustrated in FIG. 1 but may be a circle, a triangle, a polygon, or any other shape. Furthermore, the opening portion 203 may be used as the position reference portion 202.

In addition, the configuration is not limited to the configuration in which the opening portions 203 are disposed in the leader member LDR but a configuration may be employed in which, for example, a concave portion not passing through the front and rear sides of the leader member LDR is disposed. Even in a case where the concave portion is formed, a configuration is formed in which a part of the conveying member or the like can be hanging thereon. In addition, a configuration may be employed in which notch portions are formed on sides other than the side 200*a* of the leader member LDR on which the stair portion 201 is formed. Even in such a case, a configuration is formed in which a part of the conveying member or the like can hang on the notched portion.

In an area of the leader member LDR, for example, between the position reference portion 202 and the opening portion 203, an information-maintaining portion 204 is disposed. In the information-maintaining portion 204, for example, a one-dimensional barcode pattern as illustrated in FIG. 1 or the like is formed. The barcode pattern is a pattern that can be detected, for example, by an external barcode-detecting apparatus or the like. As examples of information included in the barcode pattern, there are an ID of the leader member LDR, information (for example, the processing information of the film F, the length of the film F, the specification value of the material of the film F, and the like) relating to the film F located at the connection destination of the leader member LDR, and the like. In this embodiment, for example, although the information-maintaining portion 204 is disposed in the edge portion of each of the sides 200*c* and 200*d*, which face each other, of the leader member LDR, the present invention is not limited thereto, and, for example, a configuration may be employed in which the information-maintaining portion 204 is formed at another position (for example, a center portion or the like) of the leader member LDR. In addition, the information-maintaining portion 204 is not limited to the configuration having a one-dimensional barcode pattern as illustrated in FIG. 1, and for example, a configuration having a two-dimensional barcode pattern, a configuration in which an IC tag or the like is embedded, or a configuration in which the pattern of a memory element is formed may be employed. Furthermore, the configuration is not limited to the configuration in which the information-maintaining portions 204 are disposed at two places but, for example, a configuration may be employed in which the information-maintaining portion 204 is disposed at one place or three or more places.

(Substrate Cartridge)

Next, the configuration of a substrate cartridge that houses the above-described film substrate FB will be described. In the description presented below, for convenience of the description, an XYZ orthogonal coordinate system is set, and the positional relationship of each member will be described with reference to this XYZ orthogonal coordinate system.

Figure 3:
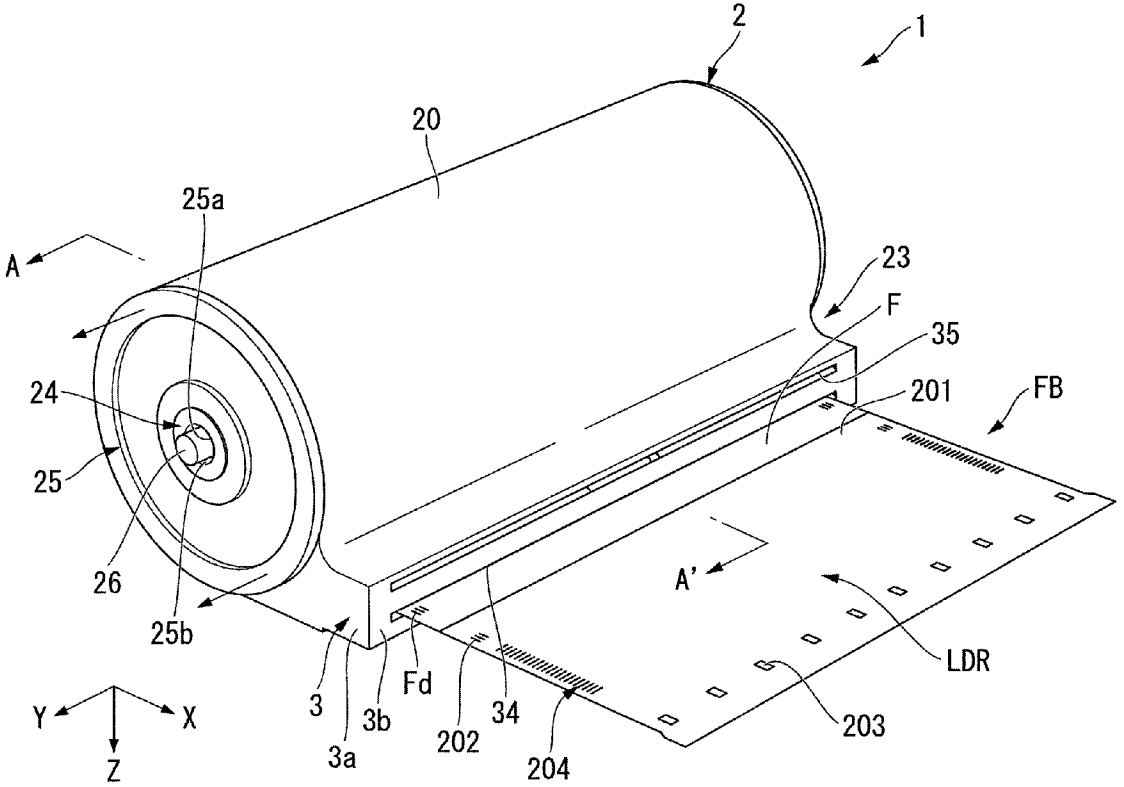
FIG. 3 is a perspective view illustrating the configuration of a substrate cartridge according to the embodiment.
Figure 4:
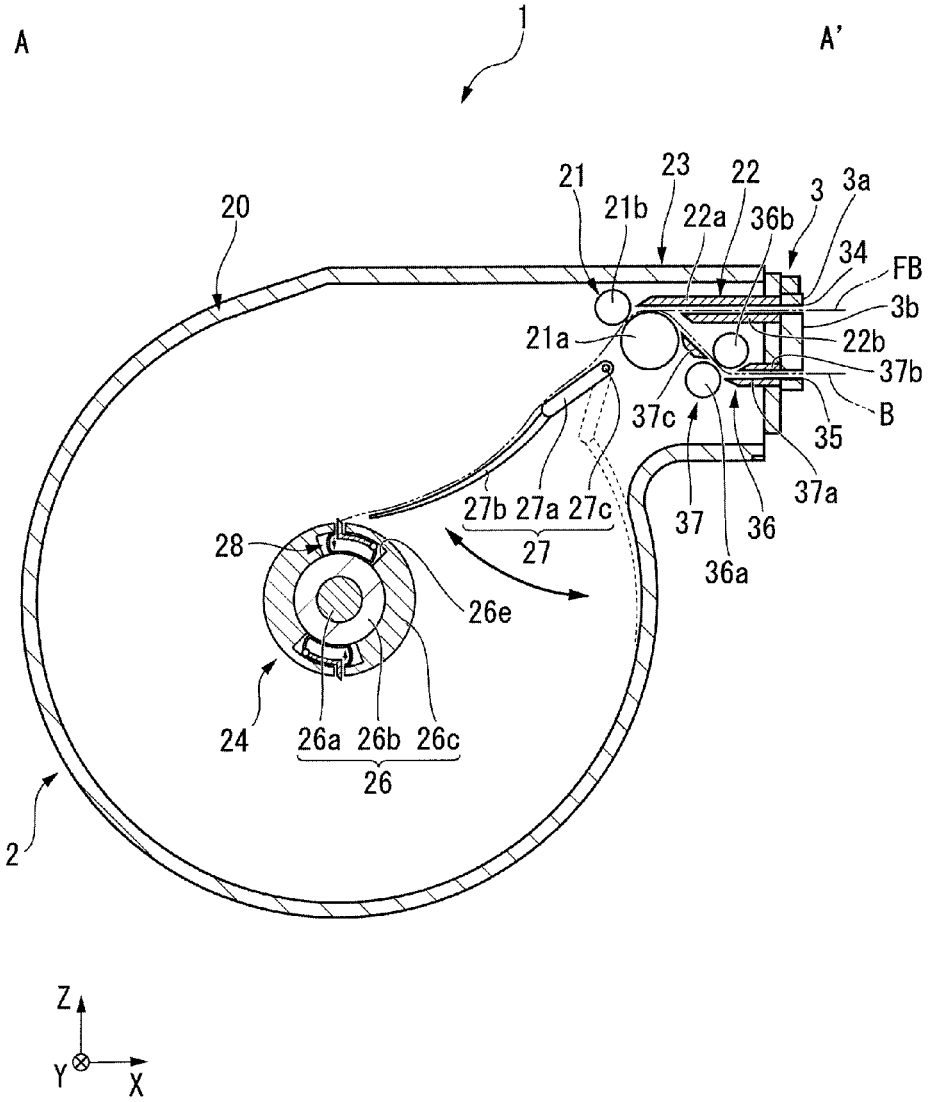
FIG. 4 is a cross-sectional view illustrating the configuration of the substrate cartridge according to the embodiment.

FIG. 3 is a perspective view illustrating the configuration of a substrate cartridge 1 according to this embodiment. FIG. 4 is a diagram illustrating the configuration taken along line A-A' shown in FIG. 3. As illustrated in FIGS. 3 and 4, the substrate cartridge 1 includes a cartridge main body 2 and a mounting unit 3.

The cartridge main body 2 is a portion that houses the sheet substrate FB. As illustrated in FIG. 4, the cartridge main body 2 includes a housing portion 20, a substrate-conveying portion (conveying mechanism) 21, a substrate-guiding portion 22, a second substrate-conveying portion 36, and a second substrate-guiding portion 37. In addition, the above-described mounting unit 3 is disposed in the cartridge main body 2. For example, the cartridge main body 2 is formed from aluminum or duralumin.

As shown in FIGS. 3 and 4, the housing portion 20 is a portion that houses the film substrate FB. The housing portion 20 is a portion that houses the film substrate FB. The housing portion 20, for example, is formed in a cylinder shape so as to house the film substrate FB wound in a roll shape, and a part thereof is disposed so as to protrude to the +X side (protruded portion 23). In this embodiment, the housing portion 20 is arranged in a state extending in the Y direction in the figure. The housing portion 20 includes a lid portion 25 and a substrate-driving mechanism 24.

The lid portion 25 is disposed in the end portion of the housing portion 20 on the +Y side or the end portion on the −Y side. The lid portion 25 is detachably attached to the housing portion 20. By detachably attaching the lid portion 25 to the housing portion 20, the inside of the housing portion 20 can be directly accessed. As an opening/closing mechanism of the lid portion 25, for example, a configuration in which screw threads engaging with each other are disposed in the lid portion 25 and the housing portion 20 may be employed or a configuration in which the lid portion 25 and the housing portion 20 are connected to each other by a hinge mechanism may be employed.

The substrate-driving mechanism 24 is a portion that performs an operation of winding up the film substrate FB and an operation of sending out the film substrate FB. The substrate-driving mechanism 24 is disposed inside the housing portion 20. The substrate-driving mechanism 24 includes a roller portion (shaft portion) 26 and a guide portion 27. The roller portion 26, as illustrated in FIG. 4, includes a rotation shaft member 26*a*, a diameter expansion portion 26*b*, and a cylindrical portion 26*c*.

The rotation shaft member 26*a* is a cylinder-shaped member that is formed from high-rigidity metal such as aluminum. The rotation shaft member 26*a* is supported to be rotatable, for example, through an opening portion 25*a* and a bearing member 25*b* disposed in the center portion of the lid portion 25. In such a case, the center shaft of the rotation shaft member 26*a*, for example, in a state of being parallel to the Y direction, and the rotation shaft member 26*a* is rotated in the θY direction.

The rotation shaft member 26*a* is connected to a rotation driving mechanism that is not illustrated in the figure. By controlling the driving of the rotation driving mechanism, the rotation shaft member 26*a* is rotated around the center shaft as its center. The rotation driving mechanism, as illustrated in FIG. 4, can rotate the rotation shaft member 26*a*, for example, in any one of the +θY direction and −θY direction.

The diameter expansion portion 26*b* is formed to have a uniform thickness on the surface of the rotation shaft member 26*a*. The diameter expansion portion 26*b* is formed so as to rotate integrally with the rotation shaft member 26*a*. The cylindrical portion 26*c* is formed to have a uniform thickness on the surface of the diameter expansion portion 26*b* in the cross-sectional view. The cylindrical portion 26*c* is bonded so as to cover the periphery of the diameter expansion portion 26*b*. Accordingly, the cylindrical portion 26*c* is configured to be integrally rotated together with the rotation shaft member 26*a* and the diameter expansion portion 26*b*.

Figure 5A:
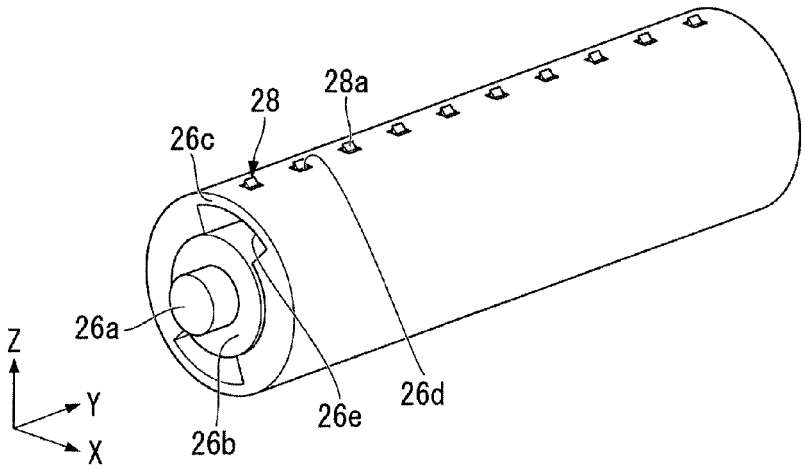
FIG. 5A is a perspective view illustrating the configuration of a part of the substrate cartridge according to the embodiment.
Figure 5B:
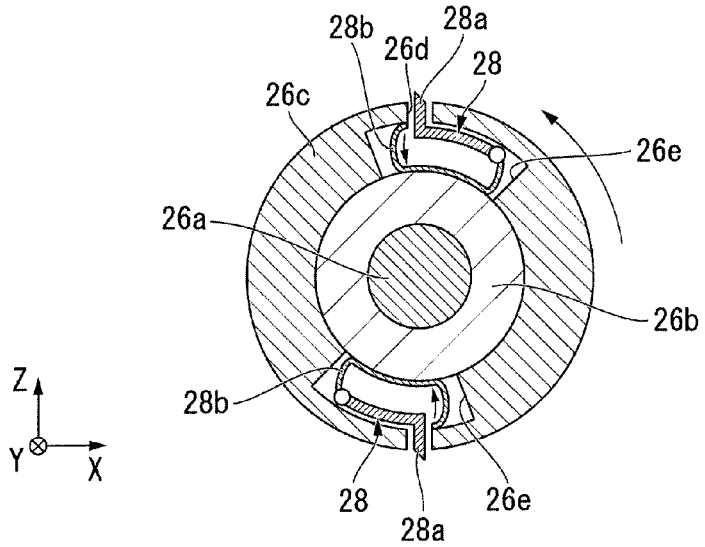
FIG. 5B is a cross-sectional view illustrating the configuration of a part of the substrate cartridge according to the embodiment.

FIG. 5A is a perspective view illustrating the configuration of a roller portion 26, and FIG. 5B is a cross-sectional view illustrating the configuration of the roller portion 26 in an enlarged scale. As illustrated in FIGS. 5A and 5B, the cylindrical portion 26*c* includes a concave portion 26*e* in an inner diameter portion. The concave portion 26*e*, for example, is formed from one end of the cylindrical portion 26*c* in the rotation shaft direction (the Y direction in the figure) to the other end along the direction of the rotation shaft. On the outer face side of a portion of the cylindrical portion 26*c* in which the concave portion 26*e* is disposed, an opening portion 26*d* is disposed. A plurality of the opening portions 26*d* is arranged along the rotation shaft direction. In this embodiment, for example, the opening portions 26*d* are disposed at positions corresponding to the opening portions 203 disposed in the leader member LDR of the film substrate FB. Although it is preferable that the number of the opening portions 26*d* coincide with the number of the opening portions 203 of the leader member LDR, the number of the opening portions 26*d* may be configured not to coincide with the number of the opening portions 203.

In the concave portion 26*e*, an engagement mechanism 28 that is inserted into the opening portions 203 of the leader member LDR so as to be engaged therewith is disposed. The engagement mechanism 28 includes a claw member 28*a* and a pressing member 28*b*. The claw member 28*a* is disposed so as to be inserted into or detachable from the opening portions 26*d*. The pressing member 28*b* is an elastic member that presses the claw member 28*a* such that the claw member 28*a* protrudes from the opening portions 26*d* to the outer face of the cylindrical portion 26*c*. The pressing member 28*b* is configured to be elastically transformed by causing the claw member 28*a* to apply a force to the inner diameter side. The claw member 28*a* is configured to be housed inside the opening portions 26*d* according to the elastic transformation of the pressing member 28*b*.

In this embodiment, in a case where a film substrate FB is not wound, the claw member 28*a* is in the state of being protruded from the outer face of the cylindrical portion 26*c* by the pressing member 28*b*. The cylindrical portion 26*c* is formed by using a material having sufficient adhesiveness for bonding the film substrate FB.

In addition, as illustrated in FIG. 4, the guide portion 27 includes a rotation member (first guide member) 27*a* and a tip end member (first guide member) 27*b*. The rotation member 27*a*, for example, has one end being disposed in a housing portion 20 through the shaft portion 27*c* and is disposed so as to be rotated in the θY direction around the shaft portion 27*c*. The rotation member 27*a* is connected to a rotation driving mechanism not illustrated in the figure.

The tip end member 27*b* is connected to the other end of the rotation member 27*a* in the cross-sectional view. The tip end member 27 is formed so as to have an arc-shaped curved face in the cross-sectional view. The film substrate FB is configured to be guided to the roller portion 26 through the +Z-side curved face that is disposed in the tip end member 27*b* and has an arc shape in the cross-sectional view. The tip end member 27*b* is configured to be rotated integrally with the rotation member 27*a*. For example, in a case where the rotation member 27*a* is rotated in a direction (the outward direction in the diameter direction of the roller portion 26) in a direction separating away from the roller portion 26, the tip end member 27*b* is brought into contact with the inner circumference of the housing portion 20. Accordingly, a contact between the tip end member 27*b* and the film substrate FB wound around the roller portion 26 is avoided.

The mounting unit 3 is a portion that is connected to a substrate-processing unit 102. The mounting unit 3, for example, is disposed in the +X-side end portion of a protruded portion 23 disposed in the housing portion 20. The mounting unit 3 includes an insertion portion 3*a* that is used for a connection with the substrate-processing unit 102. In a case where the substrate cartridge 1 is used as a substrate-supplying unit 101, the mounting unit 3 is connected to a supply-side connection portion 102A of the substrate-processing unit 102. On the other hand, in a case where the substrate cartridge 1 is used as a substrate-recovering unit 103, the mounting unit 3 is connected to a recovery-side connection portion 102B of the substrate-processing unit 102. In a case where the mounting unit 3 is connected to one of the substrate-supplying unit 101 of the substrate-processing unit 102 and the substrate-recovering unit 103, the mounting unit 3 is connected so as to be detachably attached thereto.

In the mounting unit 3, an opening portion 34 and a second opening portion 35 are disposed. The opening portion 34 is an opening portion disposed on the +Z side, and the film substrate FB is carried in or out between the opening portion 34 and the cartridge main body 2. In the cartridge main body 2, the film substrate FB is housed through the opening portion 34. The film substrate FB housed in the cartridge main body 2 is sent out to the outside of the cartridge main body 2 through the opening portion 34.

The second opening portion 35 is an opening portion that is disposed on the −Z side, and a band-shaped second substrate SB other than the film substrate FB is carried in or out between the second opening portion 35 and the cartridge main body 2. As such a second substrate SB, for example, there is a protective substrate that protects the element forming face of the film substrate FB or the like. As the protective substrate, for example, inserting paper or the like can be used. The second opening portion 35, for example, is arranged so as to be spaced from the opening portion 34. For example, the second opening portion 35 is formed to be the same size and shape as the opening portion 34. In addition, as the material of the second substrate SB according to this embodiment, a material having conductivity such as a stainless steel thin plate (for example, having a thickness equal to or less than 0.1 mm or the like) may be used. In such a case, when the second substrate SB is housed in the cartridge main body 2 together with the film substrate (sheet substrate) FB, by electrically connecting the second substrate SB to the cartridge main body 2, the charging of the film substrate (the sheet substrate) FB can be prevented.

As illustrated in FIG. 4, a substrate-conveying portion 21, a substrate-guiding portion 22, a second substrate-conveying portion 36, and a second substrate-guiding portion 37 are, for example, disposed inside the protruded portion 23. The substrate-guiding portion 22 is disposed between the opening portion 34 and the substrate-conveying portion 21. The substrate-guiding portion 22 is a portion that guides the film substrate FB between the opening portion 34 and the substrate-conveying portion 21. The substrate-guiding portion 22 includes substrate-guiding members 22*a* and 22*b*. The substrate-guiding members 22*a* and 22*b* are arranged so as to face each other with a space 22*c* interposed therebetween in the Z direction, and the opposing faces are disposed so as to be approximately parallel to the XY plane. The gap 22*c* is connected to the opening portion 34, and the film substrate FB is configured to be moved between the opening portion 34 and the gap 22*c*.

The second substrate-guiding portion 37 is a portion that guides the second substrate SB between the mounting unit 3 and the substrate-conveying portion 21. The second substrate-guiding portion 37 includes second substrate-guiding members 37*a*, 37*b*, and 37*c*. The second substrate-guiding members 37*a* and 37*b* are arranged so as to face each other with a space 37*d* interposed therebetween in the Z direction, and the opposing faces are disposed so as to be approximately parallel to the XY plane. The second substrate-guiding member 37*c* is tiltedly arranged such that the second substrate SB is guided to the +Z side. In particular, the −X-side end portion of the second substrate-guiding member 37*c* is arranged in a state being tilted to the +Z side with respect to the +X-side end portion.

The second substrate-conveying portion 36 conveys the second substrate SB between the mounting unit 3 and the substrate-conveying portion 21. The second substrate-conveying portion 36 is arranged between the second substrate-guiding members 37*a* and 37*b* and the second substrate-guiding member 37*c*. The second substrate-conveying portion 36 includes a main driving roller 36*a* and a driven roller 36*b*. The main driving roller 36*a* is disposed so as to be rotatable, for example, in the θY direction and is connected to a rotation driving mechanism not illustrated in the figure. The driven roller 36*b* is arranged so as to have a space from the main driving roller 36*a* such that the second substrate SB is interposed between the main driving roller 36*a* and the driven roller 36*b*.

The substrate-conveying portion 21 conveys the film substrate FB and the second substrate SB between the mounting unit 3 and the housing portion 20. The substrate-conveying portion 21 includes a tension roller (tension mechanism) 21*a* and a measurement roller (measurement portion) 21*b*. The tension roller 21*a* is a roller that applies tension to the film substrate FB and the second substrate between the roller portion 26 and the tension roller 21*a*. The tension roller 21*a* is disposed so as to be rotatable in θY direction. For example, a rotation mechanism not illustrated in the figure is connected to the tension roller 21*a*. In addition, the tension roller 21*a* and the measurement roller 21*b* may be disposed so as to be respectively movable in the Z direction shown in FIG. 4.

The measurement roller 21*b* is a roller that has a diameter smaller than that of the tension roller 21*a*. The measurement roller 21*b* is arranged so as to have a predetermined gap between the tension roller 21*a* and the measurement roller 21*b* such that the film substrate FB and the second substrate SB are interposed between the tension roller 21*a* and the measurement roller 21*b*. A configuration may be employed in which the size of the gap between the measurement roller 21*b* and the tension roller 21*a* can be adjusted so as to interpose only the film substrate FB or both the film substrate FB and the second substrate SB therebetween. The measurement roller 21*b* is a driven roller that is rotated in accordance with the rotation of the tension roller 21*a*.

By rotating the tension roller 21*a* in the state in which the film substrate FB is interposed between the tension roller 21*a* and the measurement roller 21*b*, the film substrate FB can be conveyed in the winding-up direction and the sending-out direction of the film substrate FB while tension is applied to the film substrate FB.

The substrate-conveying portion 21 includes a detection portion 21*c* that detects, for example, the rotation number or the rotation angle of the measurement roller 21*b*. As the detection portion 21*c*, for example, an encoder or the like is used. According to the detection portion 21*c*, for example, the conveying distance of the film substrate FB through the measurement roller 21*b* or the like can be measured.

For example, in a case where the film substrate FB is inserted through the opening portion 34, and the second substrate SB is inserted through the second opening portion 35, the film substrate FB and the second substrate SB are guided by the substrate-guiding portion 22 and the second substrate-guiding portion 37, thereby joining together in a joining portion 39. At this time, the film substrate FB and the second substrate SB jointed in the joining portion 39 are conveyed by the substrate-conveying portion 21 in the state of being joined. At this time, the substrate-conveying portion 21 presses the film substrate FB and the second substrate SB so as to be brought into tight contact with each other. Accordingly, the substrate-conveying portion 21 also serves as a pressing mechanism that presses the second substrate SB to the film substrate FB.

(Organic EL Element and Substrate-Processing Apparatus)

Figure 6A:
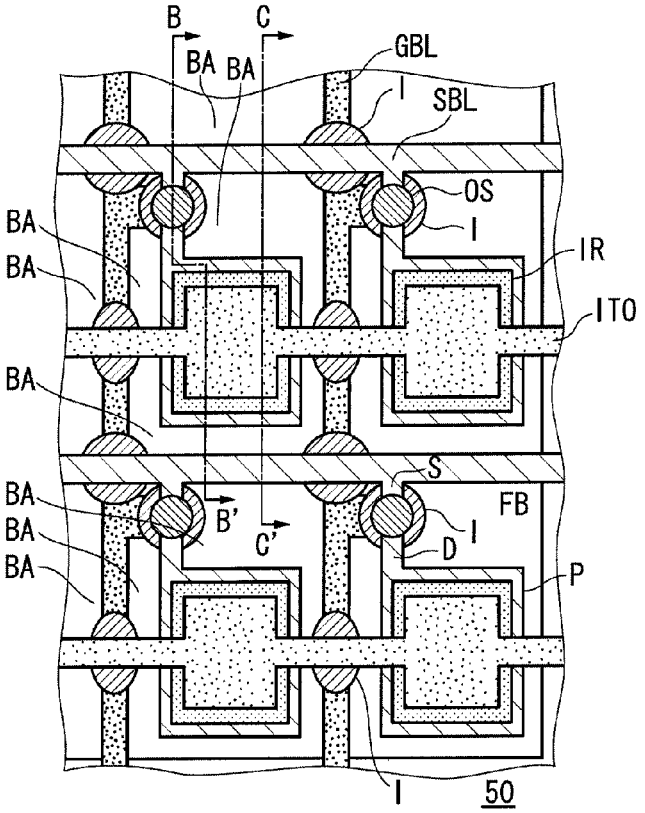
FIG. 6A is a configuration diagram of an organic EL element that is formed by a substrate-processing apparatus according to the embodiment.
Figure 6B:
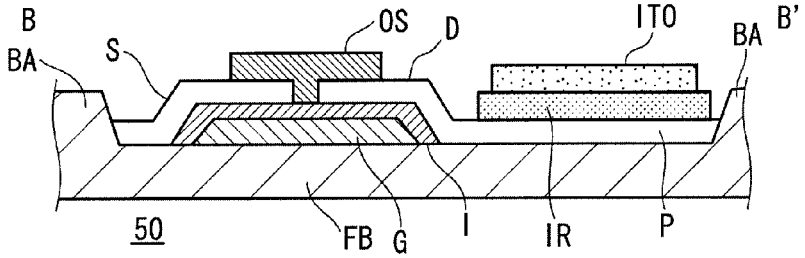
FIG. 6B is a configuration diagram of an organic EL element that is formed by the substrate-processing apparatus according to the embodiment.
Figure 6C:
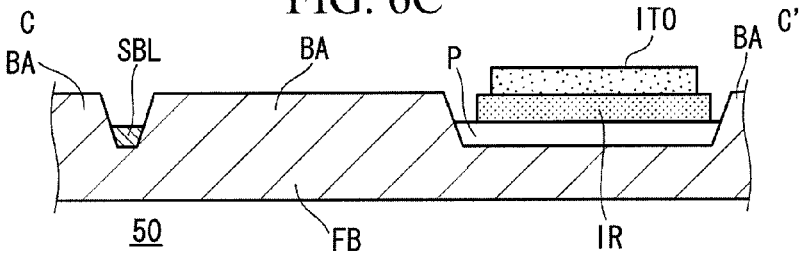
FIG. 6C is a configuration diagram of an organic EL element that is formed by the substrate-processing apparatus according to the embodiment.

Next, the configuration of an organic EL element as an example of an element manufactured by using the above-described film substrate FB will be described. FIG. 6A is a plan view illustrating the configuration of an organic EL element. FIG. 6B is a cross-sectional view taken along line B-B' shown in FIG. 6A. FIG. 6C is a cross-sectional view taken along line C-C' shown in FIG. 6A.

As illustrated in FIGS. 6A and 6B, the organic EL element 50 is a bottom contact type in which a gate electrode G and a gate-insulating layer I are formed on a film substrate FB, a source electrode S, a drain electrode D, and a pixel electrode P are further formed, and then, an organic semiconductor layer OS is formed.

As illustrated in FIG. 6B, the gate-insulating layer I is formed on the gate electrode G. On the gate-insulating layer I, a source electrode S of a source bus line SBL is formed, and the drain electrode D that is connected to the pixel electrode P is formed. In addition, the organic semiconductor layer OS is formed between the source electrode S and the drain electrode D. Accordingly, a field-effect transistor is completed. In addition, on the pixel electrode P, as illustrated in FIGS. 6B and 6C, a light-emitting layer IR is formed, and a transparent electrode ITO is formed on the light-emitting layer IR.

As can be understood from FIGS. 6B and 6C, for example, partition walls BA (bank layer) are formed on the film substrate FB. In addition, as illustrated in FIG. 6C, the source bus line SBL is formed between the partition walls BA. As above, since the partition walls BA are present, the source bus line SBL is formed with high precision, and the pixel electrode P and the light-emitting layer IR are correctly formed. Although not illustrated in FIGS. 6B and 6C, a gate bus line GBL is formed between the partition walls BA, similarly to the source bus line SBL.

This organic EL element 50 is appropriately used not only in a display apparatus such as a display apparatus but also a display unit of an electronic apparatus or the like. In such a case, for example, the organic EL element 50 formed in a panel state is used. In manufacturing such an organic EL element 50, a substrate needs to be formed in which thin film transistors (TFTs) and pixel electrodes are formed. In order to form one or more organic compound layers (light-emitting element layers) including the light-emitting layer on the pixel electrodes formed on the substrate with high precision, it is necessary to easily form the partition walls BA (bank layer) in boundary areas of the pixel electrodes with high precision.

Figure 7:
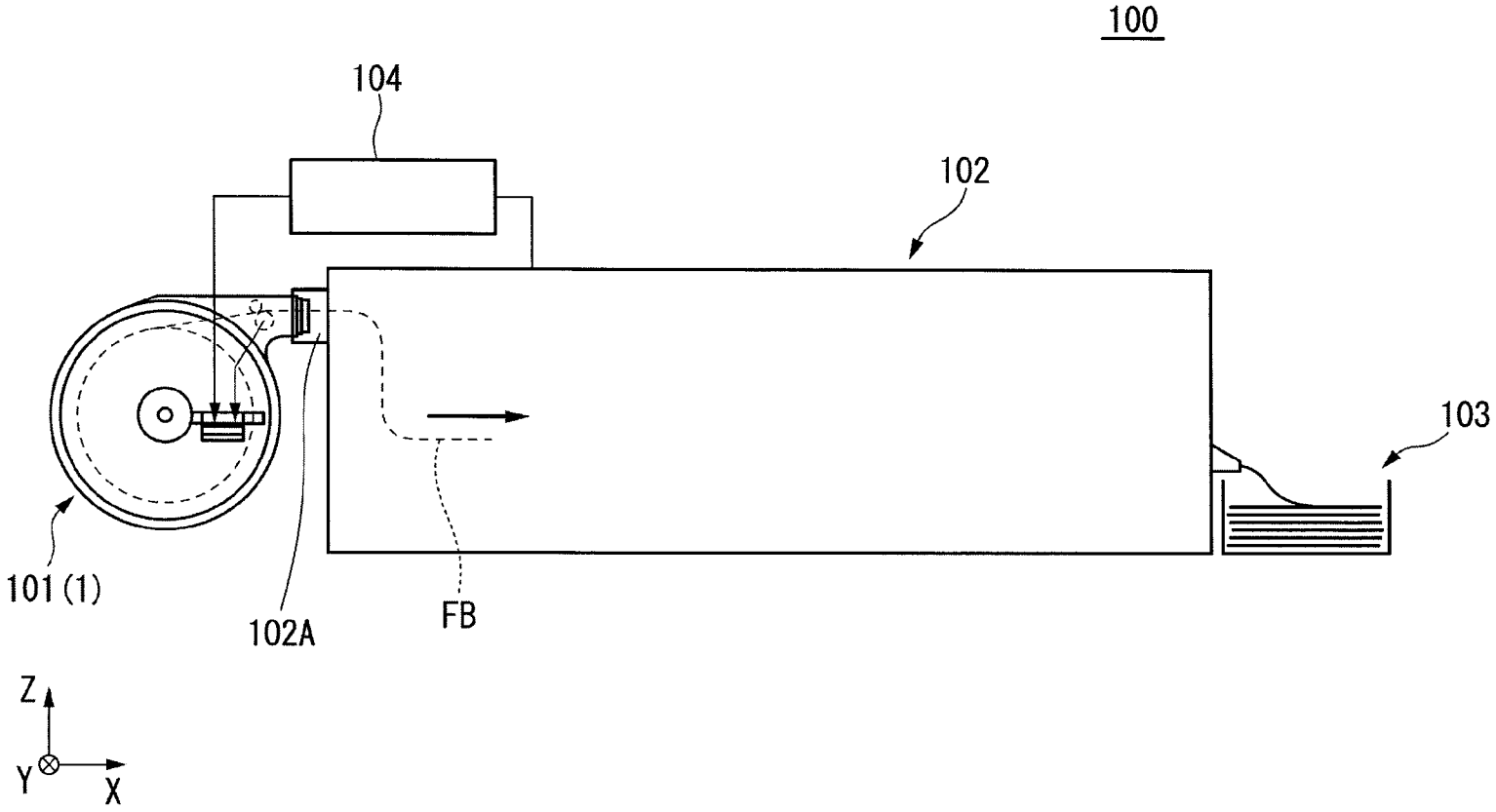
FIG. 7 is a diagram illustrating the configuration of the substrate-processing apparatus according to the embodiment.

FIG. 7 is a schematic diagram illustrating the configuration of the substrate-processing apparatus 100.

The substrate-processing apparatus 100 is an apparatus that forms the organic EL element 50 illustrated in FIGS. 6A o 6C by using the above-described film substrate FB. As illustrated in FIG. 7, the substrate-processing apparatus 100 includes a substrate-supplying unit 101, a substrate-processing unit 102, a substrate-recovering unit 103, and a control section 104. The film substrate FB in which the leader member LDR is connected to the film F is configured to be automatically conveyed to the substrate-recovering unit 103 from the substrate-supplying unit 101 through the substrate-processing unit 102. In addition, the film substrate FB, for example, is automatically conveyed between the processing units (for example, the electrode-forming portion 92, the light-emitting layer-forming portion 93, or the like) of the substrate-processing apparatus 100. By using the leader member LDR of the film substrate FB, the substrate-processing apparatus 100 can easily convey the film substrate FB with high precision. The control section 104 controls the overall operation of the substrate-processing apparatus 100.

In the description presented below, the positional relationship between members will be described by referring to the XYZ orthogonal coordinate system, used in FIGS. 3 to 5B and a common coordinate system. In the XYZ orthogonal coordinate system, within the horizontal plane, the conveying direction of the film substrate FB is set as the X axis direction, and a direction perpendicular to the X axis direction within the horizontal plane is set as the Y axis direction, and a direction (that is, the vertical direction) perpendicular to the X axis direction and the Y axis direction is set as the Z axis direction. In addition, the rotation (tilt) directions around the X axis, the Y axis, and the Z axis are denoted by θX, θY, and θZ directions.

The substrate-supplying unit 101 is connected to a supply-side connection portion 102A that is disposed in the substrate-processing unit 102. The substrate-supplying unit 101 supplies the film substrate FB, for example, wound in a roll shape to the substrate-processing unit 102. The substrate-recovering unit 103 recovers the film substrate FB that has been processed by the substrate-processing unit 102. As the substrate-supplying unit 101 and the substrate-recovering unit 103, for example, the above-described substrate cartridge 1 is used.

Figure 8:
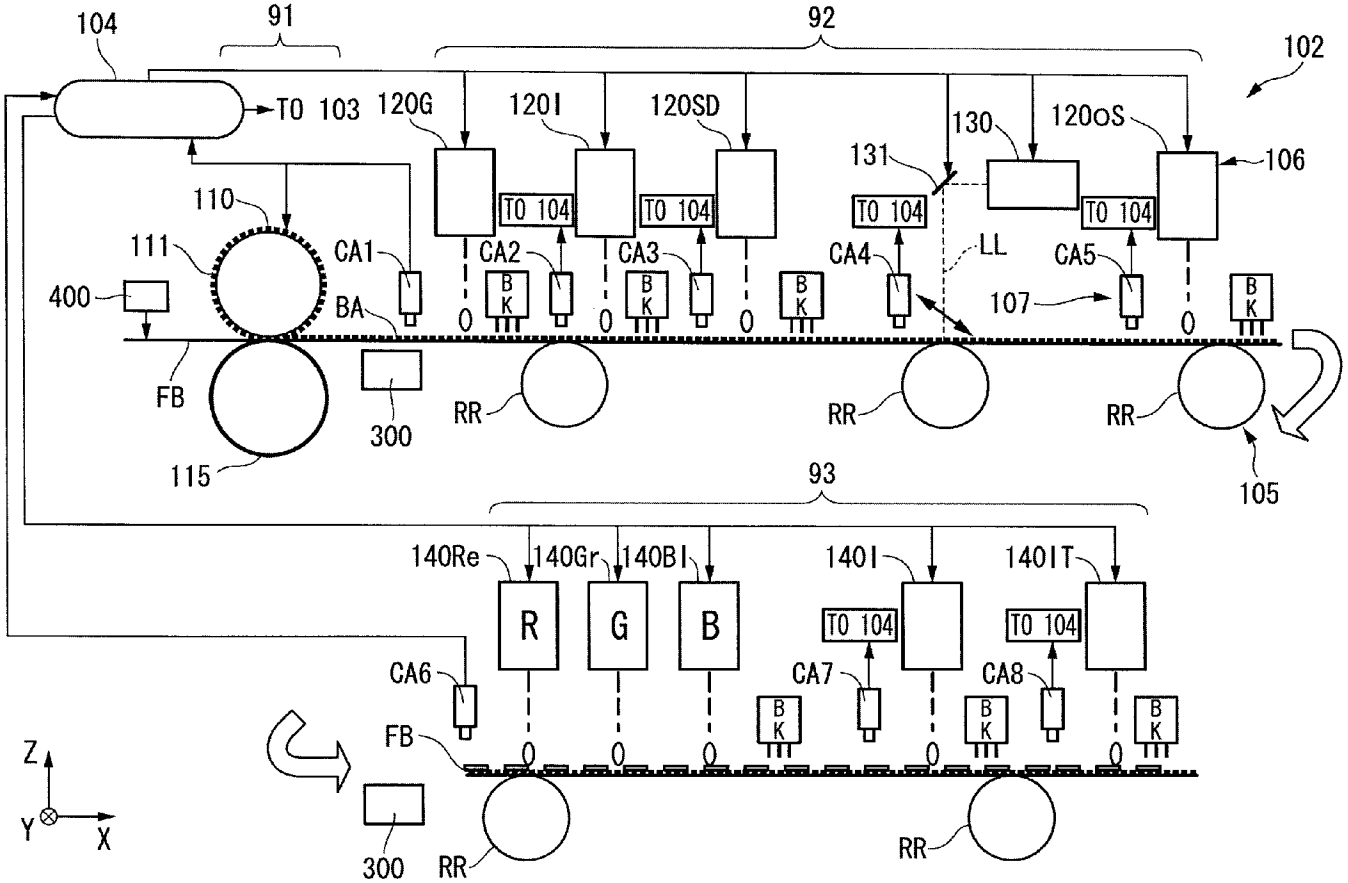
FIG. 8 is a diagram illustrating the configuration of the substrate-processing apparatus according to the embodiment.

FIG. 8 is a diagram illustrating the configuration of the substrate-processing unit 102.

As illustrated in FIG. 8, the substrate-processing unit 102 includes a conveying unit 105, an element-forming section 106, an alignment section 107, a substrate-cutting section 108, a leader member-attaching apparatus 300, and an information-detecting apparatus 400. The substrate-processing unit 102 is a portion that forms each constituent element of the above-described organic EL element 50 on the film substrate FB while conveying the film substrate FB supplied from the substrate-supplying unit 101 and sends out the film substrate FB on which the organic EL element 50 is formed to the substrate-recovering unit 103.

The conveying unit 105 includes a plurality of rollers RR (conveying sections) arranged at positions disposed along the X direction. The film substrate FB is configured to be conveyed in the X-axis direction also in accordance with the rotation of the rollers RR. The roller RR may be a rubber roller that is interposed between both faces of the film substrate FB may be a racket-attached roller RR in a case where the film substrate FB has perforations. Some rollers RR out of such rollers RR can be moved in the Y axis direction that is perpendicular to the conveying direction. In addition, the conveying unit 105 is not limited to the rollers RR, and, for example, a configuration may be employed in which a plurality of belt conveyers (conveying sections) that can adsorb at least the leader member LDR through air.

The element-forming section 106 includes a partition wall-forming portion 91, an electrode-forming portion 92, and a light-emitting layer-forming portion 93. The partition wall-forming portion 91, the electrode-forming portion 92, and the light-emitting layer-forming portion 93 are arranged in this order from the upstream side to the downstream side in the conveying direction of the film substrate FB. Hereinafter, each configuration of the element-forming section 106 will be sequentially described.

The partition wall-forming portion 91 includes an imprint roller 110 and a thermal transfer roller 115. The partition wall-forming portion 91 forms the partition walls BA for the film substrate FB sent out from the substrate-supplying unit 101. In the partition wall-forming portion 91, the film substrate FB is pressed by the imprint roller 110, and the film substrate FB is heated up to a temperature equal to or higher than the glass transition point by the thermal transfer roller 115 such that the pressed partition walls BA maintain the shape. Accordingly, the mold shape formed on the roller surface of the imprint roller 110 is configured to be transferred to the film substrate FB. The film substrate FB is configured to be heated, for example, to be about 200° C. by the thermal transfer roller 115. In addition, the imprint roller 110 and the thermal transfer roller 115 may be configured to have the function of the above-described conveying unit 105 as the conveying section. Furthermore, the above-described conveying section may be configured to be movable at least in the conveying direction (X direction) of the leader member LDR in correspondence with the length of the leader member LDR in the conveying direction.

The roller surface of the imprint roller 110 is mirror-finished, and a fine imprint mold 111 configured by using a material such as SiC or Ta is attached to the roller surface. The fine imprint mold 111 forms a stamper used for the wiring of a thin film transistor and a stamper used for a color filter.

The imprint roller 110 forms alignment marks AM on the film substrate FB by using the fine imprint mold 111. In order to form the alignment marks AM on both sides in the Y axis direction that is the widthwise direction of the film substrate FB, the fine imprint mold 111 includes a stamper used for the alignment marks AM.

The electrode-forming portion 92 is disposed on the +X side of the partition wall-forming portion 91 and, for example, forms a thin film transistor using an organic semiconductor. More particularly, after forming the gate electrode G, the gate-insulating layer I, the source electrode S, the drain electrode D, and the pixel electrode P as illustrated in FIGS. 6A to 6C, the electrode-forming portion 92 forms the organic semiconductor layer OS.

As the material of the thin film transistor (TFT), an organic semiconductor may be used although the thin film transistor is of an inorganic semiconductor system. As a thin film transistor of an inorganic semiconductor, although a thin film transistor of an amorphous silicon system is known, a thin film transistor using an organic semiconductor may be used as well. By configuring a thin film transistor by using such an organic semiconductor, the thin film transistor can be formed by using a printing technique or a liquid droplet-coating technique. In addition, a field-effect transistor (FET) as illustrated in FIGS. 6A to 6C is particularly preferable out of thin film transistors using organic semiconductors.

The electrode-forming portion 92 includes a liquid droplet-coating apparatus 120, a thermal treatment apparatus BK, a cutting apparatus 130, and the like.

In this embodiment, as the liquid droplet-coating apparatus 120, for example, a liquid droplet-coating apparatus 120G that is used when the gate electrode G is formed, a liquid droplet-coating apparatus 120I that is used when the gate-insulating layer I is formed, a liquid droplet-coating apparatus 120SD that is used when the source electrode S, the drain electrode D, and the pixel electrode P are formed, a liquid droplet-coating apparatus 120OS that is used when the organic semiconductor OS is formed, and the like are used.

Figure 9:
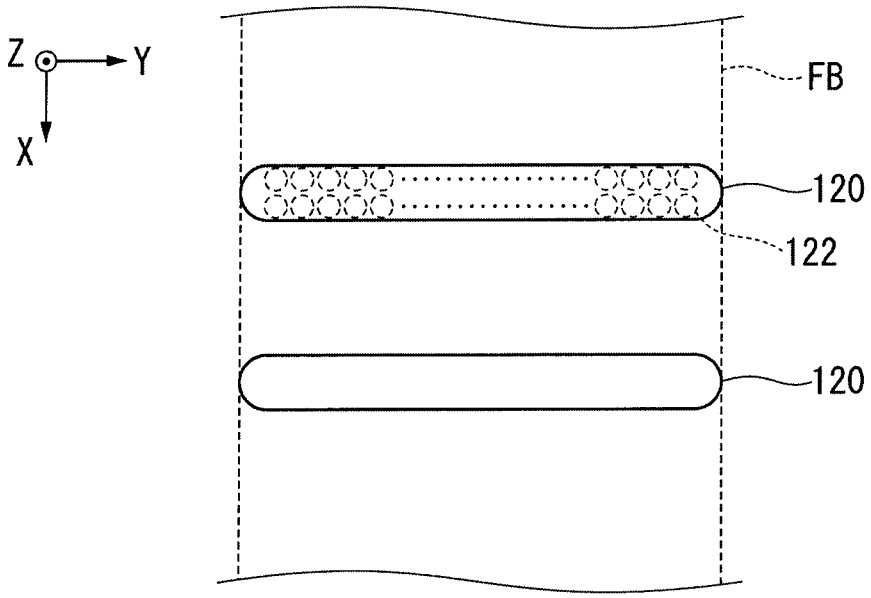
FIG. 9 is a diagram illustrating the configuration of a liquid droplet-coating apparatus according to the embodiment.

FIG. 9 is a plan view illustrating the configuration of the liquid droplet-coating apparatus 120. FIG. 9 illustrates the configuration of the liquid droplet-coating apparatus 120 when seen on the +Z side. The liquid droplet-coating apparatus 120 is formed longitudinally in the Y axis direction. In the liquid droplet-coating apparatus 120, a driving apparatus, which is not illustrated in the figure, is disposed. The liquid droplet-coating apparatus 120 is configured to be movable, for example, in the X direction, the Y direction, and the θZ direction by using the driving apparatus.

In the liquid droplet-coating apparatus 120, a plurality of nozzles 122 is formed. Each nozzle 122 is disposed on a face of the liquid droplet-coating apparatus 120 that faces the film substrate FB. The nozzles 122, for example, are arranged along the Y axis direction, and, for example, two rows (nozzle rows) of the nozzles 122 are formed. The control section 104 can perform liquid droplet coating from all the nozzles 122 or can individually adjust the timing of liquid droplet coating from each nozzle 122.

As the liquid droplet-coating apparatus 120, for example, an ink jet type or a dispenser type can be employed. As examples of the ink jet type, there are a charging control type, a compression vibration type, an electromechanical transduction type, an electro-thermal conversion type, an electrostatic attraction type, and the like. According to the liquid droplet-coating method, the material is effectively used, and a material of a desired amount can be precisely arranged at a desired position. In addition, the amount of one droplet of metal ink that is used for coating by using the liquid droplet-coating method, for example, is 1 to 300 nano grams.

As illustrated in FIG. 8, the liquid droplet-coating apparatus 120G coats the inside of the partition walls BA of the gate bus line GBL with metal ink. The liquid droplet-coating apparatus 120I coats a switching portion with electrically-insulated ink formed from polyimide-based resin or urethane-based resin. In addition, the liquid droplet-coating apparatus 120SD coats the inside of the partition wall BA of the source bus line SBL and the inside of the partition wall BA of the pixel electrode P with the metal ink. The liquid droplet-coating apparatus 120OS coats the switching portion disposed between the source electrode S and the drain electrode D with organic semiconductor ink.

The metal ink is a liquid in which conductive bodies having a particle diameter of about 5 nm are stabilized and dispersed in a room-temperature solvent, and, as the material of the conductive bodies, carbon, silver (Ag), gold (Au), or the like is used. The compound that forms the organic semiconductor ink may be either a monocrystalline material or an amorphous material and may be either a low-molecular-weight material or a high-molecular-weight material. As examples of a preferable compound that forms the organic semiconductor ink, there are a monocrystal or π-conjugated-system high-molecular-weight compound of a condensed ring system aromatic hydrocarbon compound that is represented by pentacene, triphenylene, anthracene, or the like.

The thermal treatment apparatus BK is arranged on the +X side (the downstream side in the substrate conveying direction) of each liquid droplet-coating apparatus 120. The thermal treatment apparatus BK, for example, can emit a hot air, far-infrared rays, or the like to the film substrate FB. The thermal treatment apparatus BK dries or bakes liquid droplets with which the film substrate FB is coated so as to be hardened by using the radiated heat.

The cutting apparatus 130 is disposed on the +X side of the liquid droplet-coating apparatus 120SD and on the upstream side of the coating apparatus 120OS. The cutting apparatus 130 cuts off the source electrode S and the drain electrode D formed by the liquid droplet-coating apparatus 120SD, for example, by using laser light or the like. The cutting apparatus 130 includes a light source, which is not illustrated in the figure, and a galvanometer mirror 131 that projects laser light emitted from the light source onto the film substrate FB.

As the kind of the laser light, laser of a wavelength that is absorbed in the metal film to be cut may be used, and, as the wavelength-converted laser, second, third, or fourth harmonic waves such as YAG may be used. In addition, by using pulse-type laser, thermal diffusion is prevented, and damage to portions other than the cut portion can be reduced. In a case where the material is aluminum, femtosecond laser of a wavelength of 760 nm is preferable.

In this embodiment, for example, a femtosecond laser irradiation unit that uses titanium sapphire laser is used as the light source. The femtosecond laser irradiation unit is configured to emit laser light LL, for example, as a pulse in the range of 10 KHz to 40 KHz.

In this embodiment, since the femtosecond laser is used, processing in the order of sub-microns can be performed, and a gap between the source electrode S and the drain electrode D, which determines the performance of a field-effect transistor, can be correctly cut. The gap between the source electrode S and the drain electrode D, for example, is in the range of about 3 μm to 30 μm.

Other than the above-described femtosecond laser, for example, carbon dioxide laser, green laser, or the like can be used. In addition, other than the laser, a configuration may be employed in which the substrate is mechanically cut by using a dicing saw or the like.

The galvanometer mirror 131 is arranged in the optical path of the laser light LL. The galvanometer mirror 131 reflects the laser light LL emitted from the light source onto the film substrate FB. The galvanometer mirror 131 is disposed so as to be rotatable, for example, in the θX direction, the θY direction, and the θZ direction. By rotating the galvanometer mirror 131, the emission position of the laser beam LL is changed.

By using both the partition wall-forming portion 91 and the electrode-forming portion 92, a thin film transistor and the like can be formed by using a printing technique or a liquid droplet-coating method without using a so-called photolithographic process. For example, in a case where only the electrode-forming portion 92, for which a printing technique, a liquid droplet-coating method, or the like is used, is used, there is case where a thin film transistor and the like may not be formed with high precision due to blurring or spreading of ink.

In contrast to this, by using the partition wall-forming portion 91, the partition walls BA are formed, whereby blurring and spreading of ink are prevented. In addition, the gap between the source electrode S and the drain electrode D, which determines the performance of a thin film transistor, is formed through laser processing or mechanical processing.

The light-emitting layer-forming portion 93 is arranged on the +X side of the electrode-forming portion 92. The light-emitting layer-forming portion 93 forms a light-emitting layer IR, a pixel electrode ITO, and the like on the film substrate FB on which electrodes are formed. The light-emitting layer-forming portion 93 includes a liquid droplet-coating apparatus 140 and the thermal treatment apparatus BK.

The light-emitting layer IR formed by the light-emitting layer-forming portion 93 contains a host compound and a phosphorescent compound (also referred to as a phosphorescent light-emitting compound). The host compound is a compound that is contained in the light-emitting layer. The phosphorescent compound is a compound in which light emission is observed from an excited triplet and emits phosphorescent light at room temperature.

In this embodiment, as the liquid droplet-coating apparatus 140, for example, a liquid droplet-coating apparatus 140Re that forms a red light-emitting layer, a liquid droplet-coating apparatus 140Gr that forms a green light-emitting layer, a liquid droplet-coating apparatus 140B1 that forms a blue light-emitting layer, a liquid droplet-coating apparatus 140I that forms an insulating layer, a liquid droplet-coating apparatus 140IT that forms a transparent electrode ITO, and the like are used.

As the liquid droplet-coating apparatus 140, similarly to the above-described liquid droplet-coating apparatus 120, an inkjet type or a dispenser type can be employed. In a case where, for example, a hole transport layer, an electron transport layer, and the like are disposed as the constituent elements of the organic EL element 50, an apparatus (for example, a liquid droplet-coating apparatus, or the like) that forms such layers is separately disposed.

The liquid droplet-coating apparatus 140Re coats the pixel electrode P with an R solution on the upper side. In the liquid droplet-coating apparatus 140Re, the amount of ejection of the R solution is adjusted such that the film thickness after drying is 100 nm. As the R solution, for example, a solution is used which is acquired by dissolving a red dopant material in 1,2-dichloroethane in polyvinyl carbazole (PVK) as a host material.

The liquid droplet-coating apparatus 140Gr coats the pixel electrode P with a G solution on the upper side. As the G solution, for example, a solution is used which is acquired by dissolving a green dopant material in 1,2-dichloroethane in PVK as a host material.

The liquid droplet-coating apparatus 140B1 coats the pixel electrode P with a B solution on the upper side. As the B solution, for example, a solution is used which is acquired by dissolving a blue dopant material in 1,2-dichloroethane in PVK as a host material.

The liquid droplet-coating apparatus 120I coats a part of the gate bus line GBL or the source bus line SBL with electrically-insulated ink. As the electrically insulating ink, for example, ink of a polyimide-system resin or urethane-system resin is used.

The liquid droplet-coating apparatus 120IT coats the red, green, and blue light-emitting layers with ITO (Indium Tin Oxide) on the upper side. As the ITO ink, a compound acquired by adding tin oxide ($SnO_2$) of several % to indium oxide ($In_2O_3$) or the like is used. In addition, an amorphous material such as IDIXO ($In_2O_3$—ZnO) that can be used for manufacturing a transparent conductive film may be used. It is preferable that the transmittance of the transparent conductive film be equal to or higher than 90%.

The thermal treatment apparatus BK is arranged on the +X side (the downstream side in the substrate conveying direction) of each liquid droplet-coating apparatus 140. The thermal treatment apparatus BK, similarly to the thermal treatment apparatus BK used by the electrode-forming portion 92, for example, can emit a hot wind, far-infrared rays, or the like to the film substrate FB. The thermal treatment apparatus BK dries or bakes liquid droplets with which the film substrate FB is coated so as to be hardened by using the radiated heat.

The alignment section 107 includes a plurality of alignment cameras CA (CA1 to CA8) disposed in the X direction. The alignment camera CA may be configured to perform imaging by using CCDs or CMOSs under the illumination of visible light and detect the position of an alignment mark AM by processing the captured image or may emit laser light to the alignment mark AM and detect the position of the alignment marks AM by receiving the scattering light.

The alignment camera CA1 is arranged on the +X side of the thermal transfer roller 115. The alignment camera CA1 detects the position of the alignment mark AM formed by the thermal transfer roller 115 on the film substrate FB. The alignment cameras CA2 to CA8 are arranged on the +X side of the thermal treatment apparatus BK. The alignment cameras CA2 to CA8 detect the position of the alignment mark AM of the film substrate FB that has passed through the thermal treatment apparatus BK.

There is a case where the film substrate FB expands or contracts in the X axis direction and the Y axis direction by passing through the thermal transfer roller 115 and the thermal treatment apparatus BK. By arranging the alignment camera CA on the +X side of the thermal transfer roller 115 that performs a thermal treatment as above or the +X side of the thermal treatment apparatus BK, the positional deviation of the film substrate FB due to thermal deformation or the like can be detected.

The detection results acquired by the alignment cameras CA1 to CA8 are configured to be transmitted to the control section 104. For example, the control section 104 is configured to perform adjustment of the coating position and the coating timing of ink for the liquid droplet-coating apparatus 120 and the liquid droplet-coating apparatus 140, adjustment of the supply speed of the film substrate FB from the substrate-supplying unit 101 or the conveying speed of the roller RR, adjustment of the movement according to the roller RR in the Y direction, and adjustment of the cutting position, the cutting timing, and the like of the cutting apparatus 130 based on the detection results of the alignment cameras CA1 to CA8.

The leader member-attaching apparatus 300, for example, is an apparatus that cuts the film F of the film substrate FB and attaches the leader member LDR to the cut portion. Inside the substrate-processing unit 102, one or a plurality of leader member attaching apparatuses 300 is disposed. In this embodiment, a total of two leader member attaching apparatuses 300 are disposed, including one disposed between the partition wall-forming portion 91 and the electrode-forming portion 92 and one disposed between the electrode-forming portion 92 and the light-emitting layer-forming portion 93.

The leader member-attaching apparatus 300, for example, includes a cutting unit that cuts a film F, a position reference-forming unit that forms a film-side position reference portion Fd on the film F, a position-aligning unit which performs position alignment with the position reference portion of the leader member LDR and the film-side position reference portion Fd of the film F, and the like.

The information-detecting apparatus 400, for example, is an apparatus that detects information maintained in the information-maintaining section 204 of the leader member LDR. The information detected by the information-detecting apparatus 400, for example, is supplied to the control section 104. The information-detecting apparatus 400, for example, is disposed on the upstream side of the partition wall-forming portion 91 of the substrate-processing unit 102. By arranging the information-detecting apparatus 400 on the upstream side of the partition wall-forming portion 91, before the partition wall-forming process that is the substantially first process of the substrate-processing unit 102 to the film substrate FB, the information of the film substrate FB is supplied to the substrate-processing unit 102 (or the control section 104). Since the substrate-processing unit 102 can perform each process such as the partition wall-forming process based on the information, an optimal process according to the information on the film substrate FB is performed. Here, a position at which the information-detecting apparatus 400 is arranged is not limited to the upstream side of the partition wall-forming portion 91 but may be any position within the substrate-processing unit 102 as long it is a position at which the information maintained in the information-maintaining section 204 can be read out. In a case where the information maintained in the information-maintaining section 204 is used for the process inside the substrate-processing unit 102, it is preferable that the information-detecting apparatus 400 be disposed further on the upstream side than the substrate-processing unit 102. In addition, in this embodiment, the reader member-attaching apparatus 300 may be arranged further on the upstream side than the partition wall-forming portion 91 and may be an apparatus that attaches the leader member LDR to a predetermined position of the film substrate FB.

In this embodiment, for example, in a case where a one-dimensional barcode is formed as the information-maintaining section 204, a one-dimensional barcode-reading apparatus is used as the information-detecting apparatus 400. In addition, in a case where a two-dimensional barcode is formed as the information-maintaining section 204, a two-dimensional barcode-reading apparatus is used as the information-detecting apparatus 400. Similarly, in a case where an IC tag or a pattern of memory elements is formed as the information-maintaining section 204, an apparatus that can read out information maintained therein is used as the information-detecting apparatus 400. It is apparent that an apparatus having a function of being able to read out a plurality of types of information including at least a part of the types described above may be used as the information-detecting apparatus 400.

(Manufacturing Operation of Film Substrate)

Figure 10:
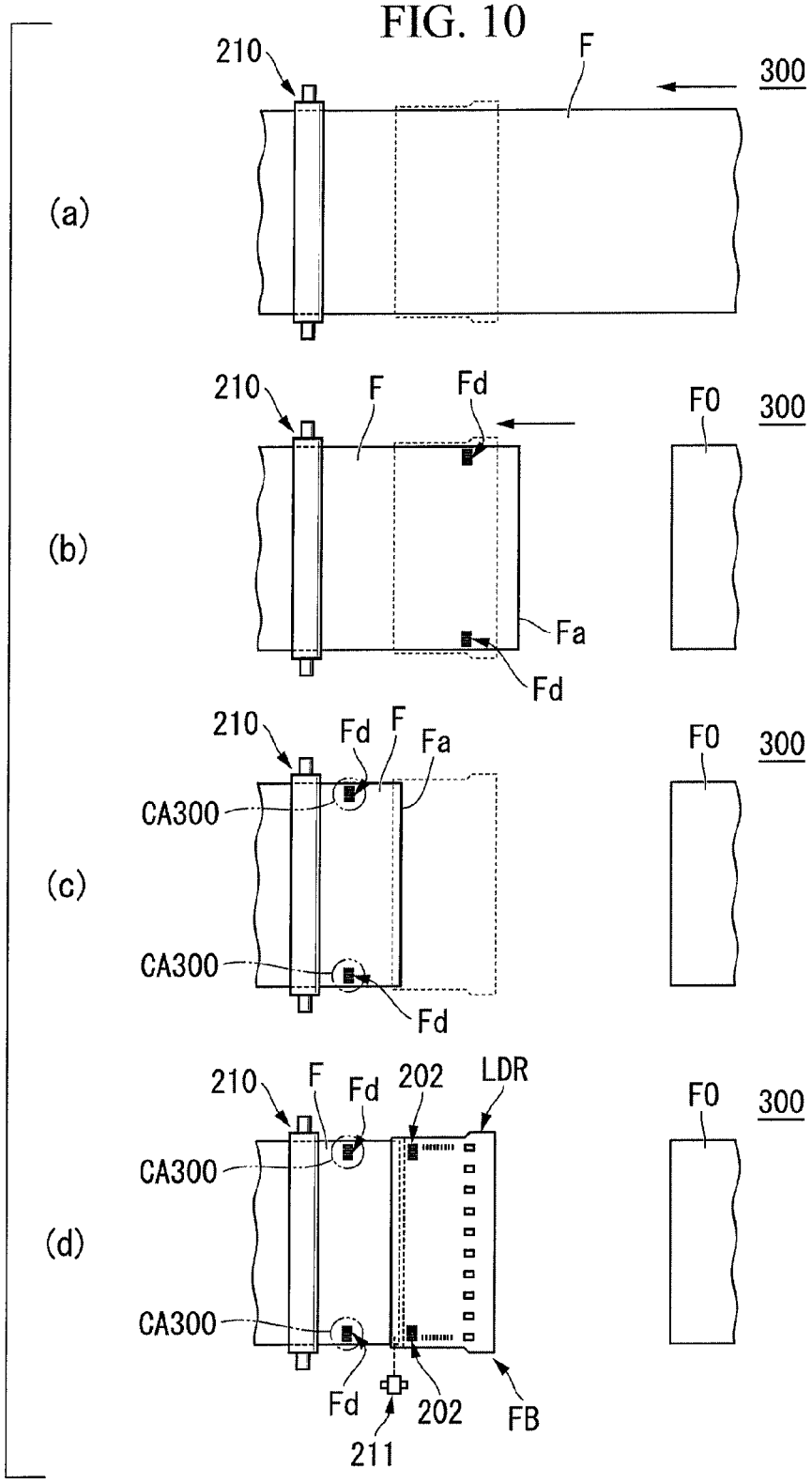
FIG. 10 is a diagram illustrating the manufacturing process of a film substrate FB according to the embodiment.

Next, the process of manufacturing the above-described film substrate FB will be described. FIGS. 10(*a*) to 10(*d*) are diagrams illustrating the manufacturing process of the film substrate FB. The manufacturing of the film substrate FB, for example, is performed by an apparatus having the same configuration as that of the above-described leader member-attaching apparatus 300. The attachment of the leader member LDR, for example, is performed on a stage that is not illustrated in the figure. Broken-line portions illustrated in FIGS. 10(*a*) to 10(*c*) represent positions at which the leader member LDR is to be attached.

First, as illustrated in FIG. 10(*a*), a film F is arranged so as to pass through a position at which the leader member LDR is to be attached, for example, by using the conveying roller 210 or the like. In FIG. 10(*a*), although an example is illustrated in which the film F is conveyed from the right side to the left side in the figure, the conveying direction may be reversed.

Next, as illustrated in FIG. 10(*b*), the film F is cut on the upstream side of the position at which the leader member LDR is to be attached in the conveying direction, film-side position reference portions Fd are formed at sections located on the conveying roller 210 side, and thereafter, the end portion Fa of the film F is conveyed to the conveying roller 210 side. In addition, the section F0 detached from the film F, for example, is fixed to a position at the time of being cut out.

Next, as illustrated in FIG. 10(*c*), the end portion Fa of the film F is arranged at the connection position. This connection position, for example, is assumed to be a position corresponding to the stair portion 201 located at the position at which the leader member LDR is to be attached. When the film is arranged, for example, the position may be adjusted while detecting the film-side position reference portion Fd formed in the film F by using the alignment camera CA300 or the like.

Next, as illustrated in FIG. 10(*d*), position alignment between the film F and the leader member LDR is performed (position-aligning process), and, after the position alignment, the leader member LDR is attached to the film F so as to be connected to each other (connecting process).

In a position-aligning process, by using the film-side position reference portions Fd disposed on the film F and the position reference portions 202 disposed in the leader member LDR, a position of the film F in the vertical direction in the figure and a position of the film F in the horizontal direction in the figure are detected (position-detecting process), and the attached position of the leader member LDR is adjusted based on the detected position. In the position-detecting process, for example, by using the alignment cameras CA300 and CA301, the film-side position reference portions Fd and the position reference portions 202 are detected. For example, before the position-aligning process, the position reference portions 202 are formed in the leader member LDR.

In a connection process, for example, as illustrated in FIG. 10(*d*), the film F and the leader member LDR are thermally compressed by using a thermo compression roller 211 or the like. It may be configured such that the leader member LDR is coated with a thermal welding-type adhesive in advance, and the film F and the leader member LDR are connected to each other by welding the adhesive.

In this embodiment, since the film F is aligned with the leader member LDR, an area (an element-forming area 60 to be described later) of the film F in which the organic EL element 50 is formed is indirectly aligned with the leader member LDR. In this embodiment, since the leader member LDR is conveyed by the conveying unit 105 with high precision, the element-forming area 60 of the film F is aligned by the leader member LDR with high precision.

(Operation of Housing Film Substrate in Substrate Cartridge)

Figure 11A:
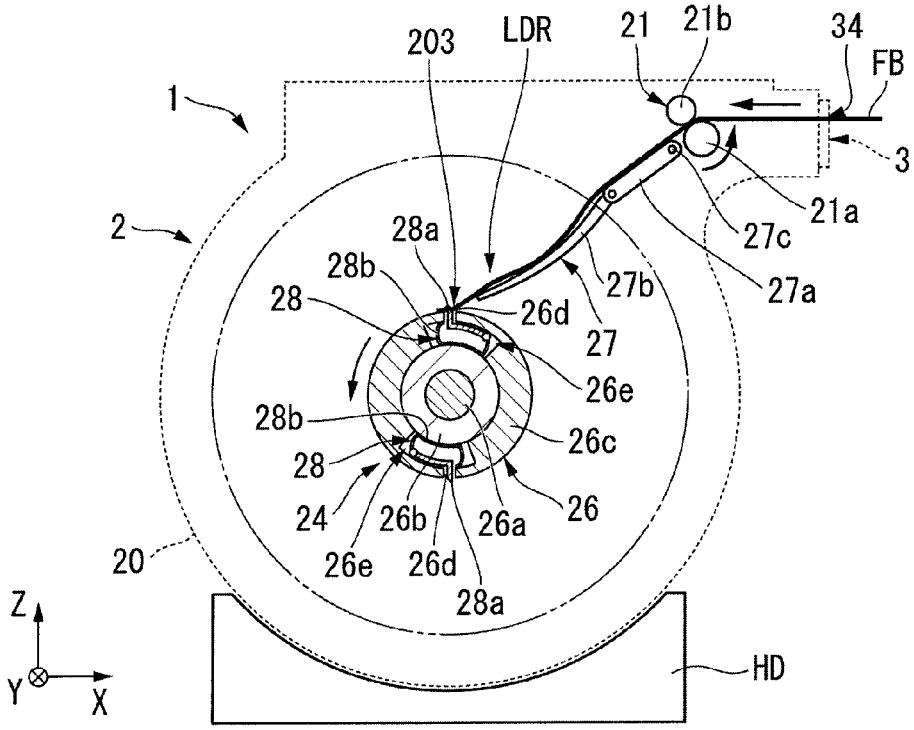
FIG. 11A is a diagram illustrating an operation of housing the substrate cartridge according to the embodiment.
Figure 11B:
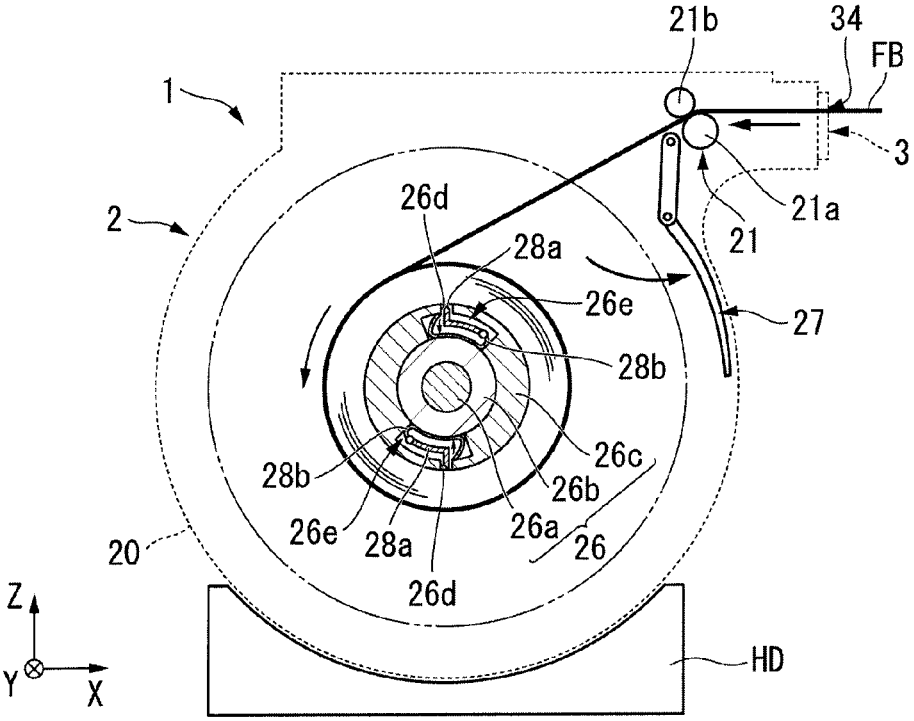
FIG. 11B is a diagram illustrating an operation of housing the substrate cartridge according to the embodiment.

Next, a housing operation for housing the film substrate FB in the substrate cartridge 1 configured as described above will be described. FIGS. 11A and 11B are diagrams illustrating the substrate cartridge 1 states when an operation of housing the substrate cartridge is performed. In FIGS. 11A and 11B, for easily understanding the figures, the outer form of the substrate cartridge 1 is denoted by dotted lines.

As illustrated in FIG. 11A, in order to house the film substrate FB in the substrate cartridge 1, in a state in which the substrate cartridge 1 is held on a holder HD, the film substrate FB is inserted through the opening portion 34. At a time when inserting the film substrate FB, the tension roller 21*a* and the rotation shaft member 26*a* (roller portion 26) are made in a rotated state.

The film substrate FB inserted through the opening portion 34 is guided to the substrate-conveying portion 21 by the substrate-guiding portion 22. In the substrate-conveying portion 21, the film substrate FB is conveyed to the housing portion 20 side while being inserted between the tension roller 21*a* and the measurement roller 21*b*. The film substrate FB passing through the substrate-conveying portion 21 on the housing portion 20 side is guided while being bent in the −Z direction according to its weight. In this embodiment, since the guide portion 27 is disposed on the −Z side of the film substrate FB, the film substrate FB is guided to the roller portion 26 along the rotation member 27*a* and the tip end member 27*b* of the guide portion 27.

When the tip end of the film substrate FB arrives at the cylindrical portion 26*c* of the roller portion 26, the claw member 28*a* protruding from the cylindrical portion 26*c* is inserted into the inside of the opening portion 203 disposed in the leader member LDR of the film substrate FB. Since each portion of the roller portion 26 is integrally rotated in this state, the film FB is wound around the cylindrical portion 26*c* in a state in which the claw member 28*a* is engaged with the opening portion 203 of the leader member LDR.

After the film substrate FB is wound around the roller portion 26, for example, by one revolution, as illustrated in FIG. 11B, the guide portion 27 is retracted. By rotating the roller portion 26 in this state, the film substrate FB is slowly wound up around the roller portion 26. Although the thickness of the wound film substrate FB is gradually thickened, the guide portion 27 is retracted already, and the film substrate FB and the guide portion 27 are avoided from being into contact with each other.

In addition, the film substrate FB is slowly wound around the cylindrical portion 26*c*, and the claw member 28*a* is pressed to the rotation shaft member 26*a* side by the wound film substrate FB. Depending on this pressing force, the pressing member 28*b* is elastically transformed, whereby the claw member 28*a* is housed in the concave portion 26*e*. After the film substrate FB is wound, the film substrate FB is conveyed while adjusting, for example, the rotation speed of the tension roller 21*a* and the rotation speed of the rotation shaft member 26*a* such that the film substrate FB is not bent between the roller portion 26 and the substrate-conveying portion 21. After a predetermined length of the film substrate FB is wound up, for example, an outer portion of the opening portion 34 of the film substrate FB is cut off. As above, the film substrate FB is housed in the substrate cartridge 1.

(Operation of Substrate-Processing Apparatus)

Next, the operation of the substrate-processing apparatus 100 configured as described above will be described.

In this embodiment, a connection operation of connecting the substrate cartridge 1 housing the film substrate FB as the substrate-supplying unit 101 to the supply-side connection portion 102A, a film substrate FB-supplying operation performed through the substrate cartridge 1 by using the substrate-supplying unit 101, an element-forming operation by using the substrate-processing unit 102, and an operation of detaching the substrate cartridge 1 are sequentially performed.

Figure 12:
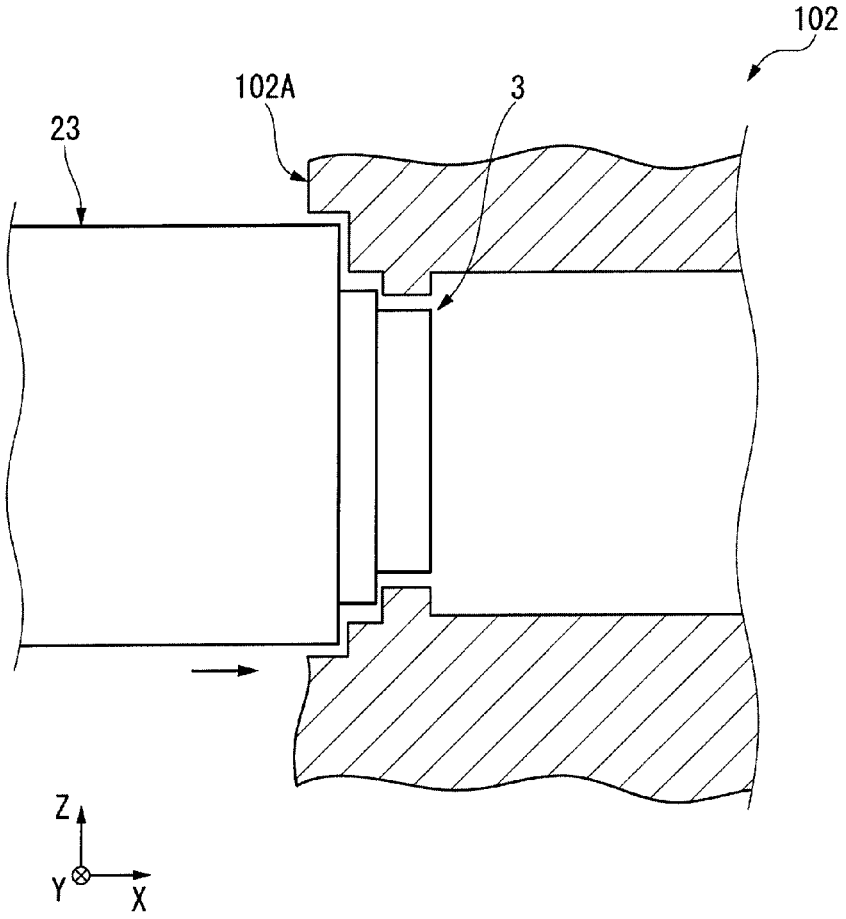
FIG. 12 is a diagram illustrating a connection operation of the substrate cartridge according to the embodiment.

First, a connection operation of the substrate cartridge 1 will be described. FIG. 12 is a diagram illustrating the connection operation of the substrate cartridge 1.

As illustrated in FIG. 12, in the supply-side connection portion 102A, an insertion opening is formed in a shape corresponding to the mounting unit 3.

In the connection operation, position alignment with the mounting unit 3 and the supply-side connection portion 102A is performed in the state in which the substrate cartridge 1 is held by the holder (for example, the same configuration as that of the holder HD illustrated in FIG. 11A). After the position alignment is performed, the mounting unit 3 is moved to the +X side so as to be inserted into the substrate-processing unit 102.

Figure 13:
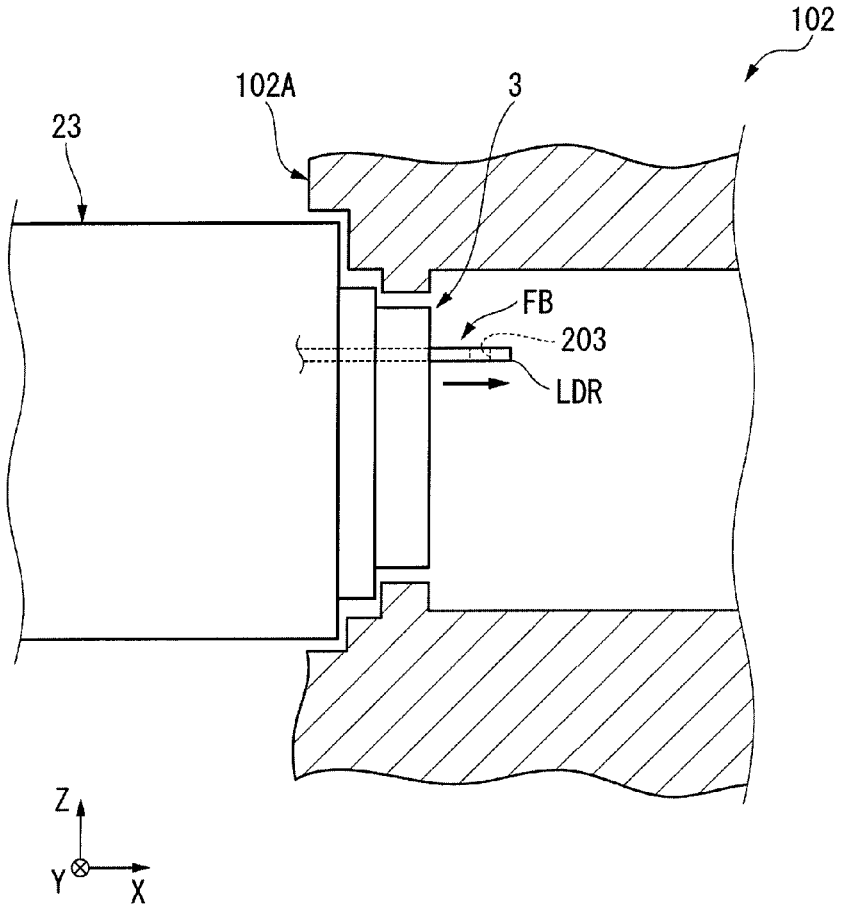
FIG. 13 is a diagram illustrating the connection operation of the substrate cartridge according to the embodiment.

Next, the supply operation will be described. In order to supply the film substrate FB to the substrate-processing unit 102, for example, the rotation shaft member 26*a* (the roller portion 26) of the substrate cartridge 1 and the tension roller 21*a* are rotated in a direction opposite to that at the time of the housing operation. As illustrated in FIG. 13, the film substrate FB is sent out through the opening portion 34. At this time, the leader member LDR is sent out from the opening portion 34 with the leader member LDR in the lead.

Next, the element-forming operation will be described. In the element-forming operation, elements are formed on the film substrate FB by the substrate-processing unit 102 while the film substrate FB is supplied from the substrate-supplying unit 101 to the substrate-processing unit 102. In the substrate-processing unit 102, the film substrate FB is conveyed by the roller RR.

In the substrate-processing unit 102, first, information maintained in the information-maintaining section 204 of the leader member LDR is detected by the information-detecting apparatus 400. The control section 104, for example, acquires information transmitted from the information-detecting apparatus 400 and controls the operation of the substrate-processing unit 102, which is performed thereafter, based on the process information. In addition, the control section 104 detects whether or not the roller RR is deviated in the Y axis direction and corrects the position by moving the roller RR in a case where there is a deviation. Furthermore, the control section 104 additionally performs the correction of the position of the film substrate FB.

The film substrate FB supplied from the substrate-supplying unit 101 to the substrate-processing unit 102, first, is conveyed to the partition wall-forming portion 91. In the partition wall-forming portion 91, the film substrate FB is pressed while being interposed between the imprint roller 110 and the thermal transfer roller 115, and partition walls BA and alignment marks AM are formed on the sheet substrate through heat transfer.

Figure 14:
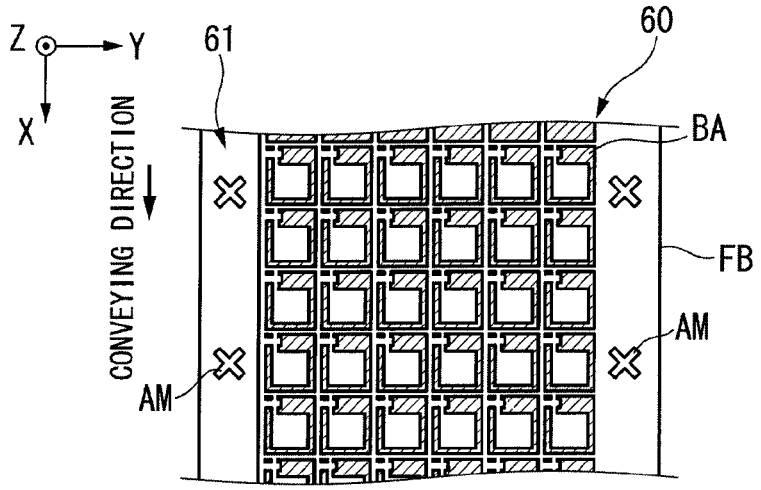
FIG. 14 is a diagram illustrating a partition wall-forming process of a substrate-processing unit according to the embodiment.
Figure 15:
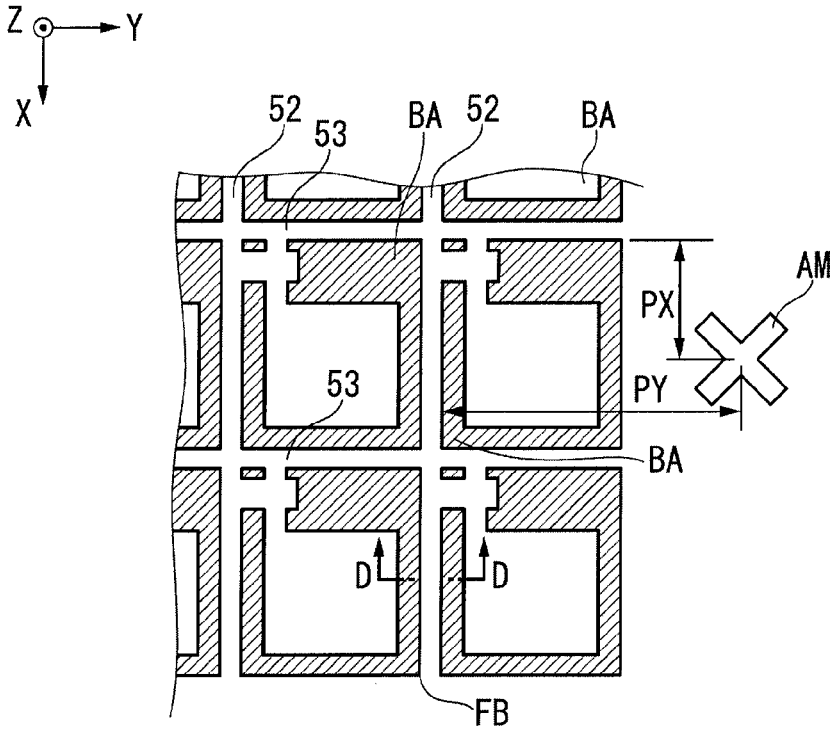
FIG. 15 is a diagram illustrating the shape and the arrangement of partition walls formed on a film substrate (sheet substrate) according to the embodiment.
Figure 16:
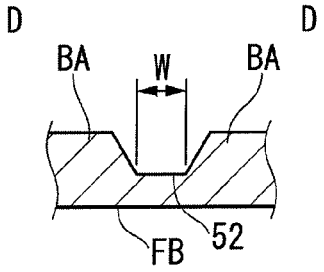
FIG. 16 is a cross-sectional view of the partition walls formed on the film substrate (sheet substrate) according to the embodiment.

FIG. 14 is a diagram illustrating a state in which the partition walls BA and the alignment marks AM are formed on the film substrate FB. FIG. 15 is a diagram acquired by partially enlarging FIG. 14. FIG. 16 is a diagram illustrating the configuration taken along line D-D shown in FIG. 15. FIGS. 14 and 15 illustrate the appearances when the film substrate FB is viewed from the +Z side.

As illustrated in FIG. 14, the partition wall BA is formed in an element-forming area 60 located in the center portion of the film substrate FB in the Y direction. As illustrated in FIG. 15, by forming the partition walls BA, in the element-forming area 60, an area (gate-forming area 52) in which the gate bus line GBL and the gate electrode G are formed and an area (the source-drain-forming area 53) in which the source bus line SBL, the source electrode S, the drain electrode D, and the anode P are formed are partitioned. As illustrated in FIG. 16, the gate-forming area 52 is formed in a trapezoidal shape in the cross-sectional view. Although not illustrated in the figure, the source-drain-forming area 53 has a shape similar thereto. The width W (μm) inside the partition wall BA is the line width of the gate bus line GBL. It is preferable that the width W be about two to four times of the diameter d (μm) of liquid droplets used for coating from the liquid droplet-coating apparatus 120G.

In addition, for easy peel-off of the film substrate FB after pressing of the imprint mold 11 for the film substrate FB, it is preferable that the cross-sectional shapes of the gate-forming area 52 and the source-drain-forming area 53 be in the shape of "V" or "U" in the cross-sectional view. As another shape, for example, the cross-sectional shapes thereof may be a rectangle in the cross-sectional view.

As illustrated in FIG. 14, one pair of the alignment marks AM are formed in the edge areas 61 located on both end portions of the film substrate FB in the Y direction. Since a mutual positional relationship between the partition wall BA and the alignment mark AM is important, the partial wall BA and the alignment mark AM are simultaneously formed. As illustrated in FIG. 15, a predetermined distance PY between the alignment mark AM and the gate-forming area 52 is defined in the Y axis direction, and a predetermined distance PX between the alignment mark AM and the source-drain-forming-area 53 is defined in the X axis direction. Accordingly, the deviation of the film substrate FB in the X axis direction, the deviation thereof in the Y axis direction, and the rotation θ can be detected based on the positions of the one pair of alignment marks AM.

In FIGS. 14 and 15, although one pair of the alignment marks AM are disposed for each partition wall BA of a plurality of rows in the X axis direction, the present invention is not limited thereto, and, for example, the alignment mark AM may be arranged for each row of the partition walls BA 1. In addition, in a case where there is a space, the alignment mark AM may be disposed not only in the edge area 61 of the film substrate FB but also in the element-forming area 60. Furthermore, in FIGS. 14 and 15, although the shape of the alignment mark AM is a cross shape, a shape such as a circular mark, a tilted straight line mark or the like may be used.

Subsequently, the film substrate FB is conveyed to the electrode-forming portion 92 by the conveying roller RR. In the electrode-forming portion 92, coating using liquid droplets is performed by each liquid droplet-coating apparatus 120, whereby electrodes are formed on the film substrate FB.

Figure 17A:
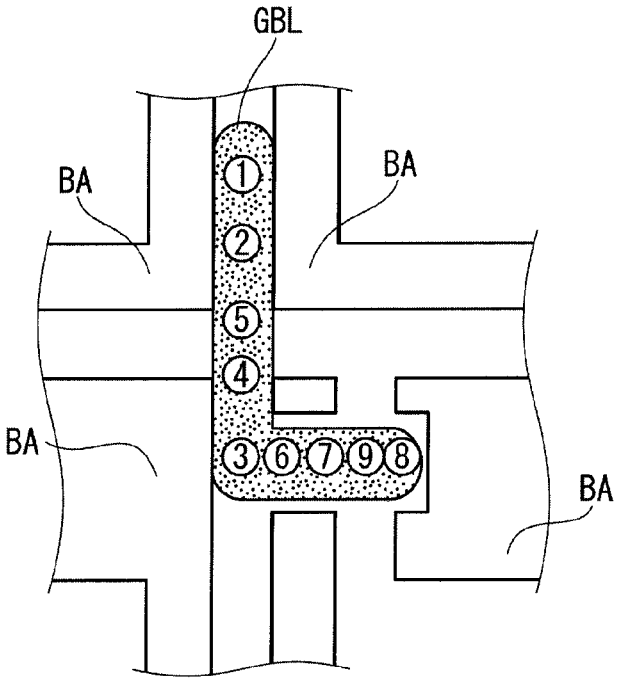
FIG. 17A is a diagram illustrating a liquid droplet-coating operation according to the embodiment.
Figure 17B:
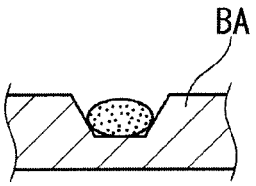
FIG. 17B is a diagram illustrating a liquid droplet-coating operation according to the embodiment.

On the film substrate FB, first, the gate bus line GBL and the gate electrode G are formed by the liquid droplet-coating apparatus 120G. FIGS. 17A and 17B are diagrams illustrating the appearances of the film substrate FB for which liquid droplet coating is performed by the liquid droplet-coating apparatus 120G.

As illustrated in FIG. 17A, the liquid droplet-coating apparatus 120G coats the gate-forming area 52 of the film substrate FB on which the partition walls BA are formed with metal ink, for example, in the order of 1 to 9. This order is an order in which, for example, coating is performed in a linear pattern due to tension of metal ink. FIG. 17B is a diagram illustrating a state in which, for example, coating is performed by using one droplet of metal ink. As illustrated in FIG. 17A, since the partition walls BA are disposed, the metal ink with which the gate-forming area 52 is coated does not diffuse but is maintained. As above, the entire gate-forming area 52 is coated with metal ink.

Figure 18A:
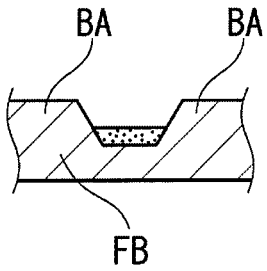
FIG. 18A is a diagram illustrating the configuration of a thin film formed between the partition walls according to the embodiment.
Figure 18B:
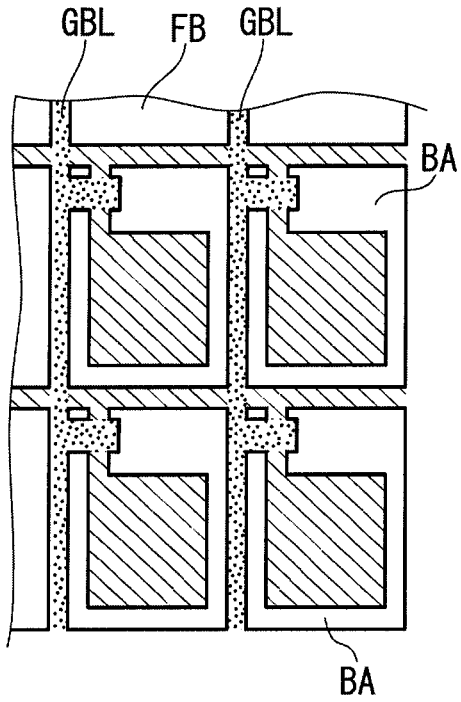
FIG. 18B is a diagram illustrating the configuration of a thin film formed between the partition walls according to the embodiment.

After the gate-forming area 52 is coated with metal ink, the film substrate FB is conveyed such that the portion coated with the metal ink is located on the −Z side of the thermal treatment apparatus BK. The thermal treatment apparatus BK performs a thermal treatment for the metal ink with which the film substrate FB is coated on the upper side, thereby drying the metal ink. FIG. 18A is a diagram illustrating the state of the gate-forming area 52 after drying the metal ink. As illustrated in FIG. 18A, by drying the metal ink, conductive bodies contained in the metal ink are laminated in a thin film state. The conductive bodies in such a thin film state are formed in the entire gate-forming area 52, and, as illustrated in FIG. 18B, the gate bus line GBL and the gate electrode G are formed on the film substrate FB.

Figure 19:
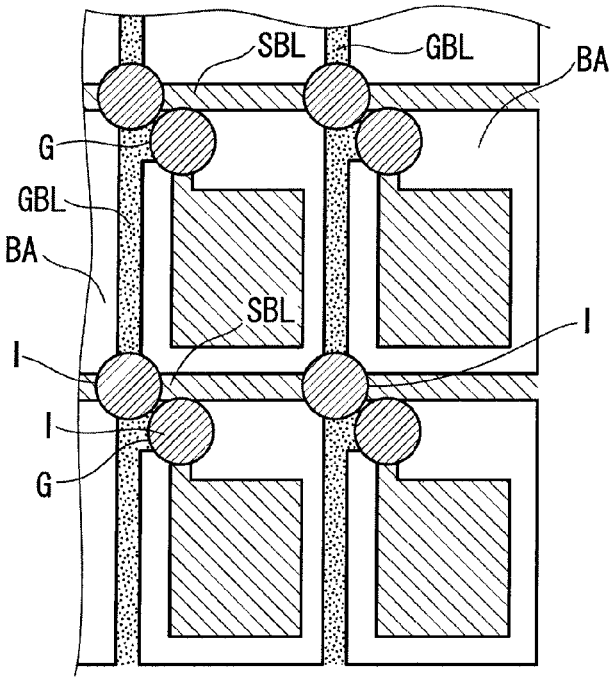
FIG. 19 is a diagram illustrating a process of forming a gate insulating film on the film substrate (sheet substrate) according to the embodiment.

Next, the film substrate FB is conveyed to the −Z side of the liquid droplet-coating apparatus 120I. In the liquid droplet-coating apparatus 120I, the film substrate FB is coated with an electrically insulating ink. In the liquid droplet-coating apparatus 120I, for example, as illustrated in FIG. 19, the upper side of the gate bus line GBL and the gate electrode G passing through the source-drain-forming area 53 is coated with the electrically insulating ink.

After the coating is performed by using the electrically insulating ink, the film substrate FB is conveyed to the −Z side of the thermal treatment apparatus BK, and a thermal treatment is performed for the electrically insulating ink by the heat treatment apparatus BK. In accordance with the thermal treatment, the electrically insulating ink is dried, whereby the gate-insulating layer I is formed. In FIG. 19, although a state is illustrated in which the gate-insulating layer I is formed in a circular shape so as to extend over the partition wall BA, the gate-insulating layer does not particularly need to be formed over the partition wall BA.

Figure 20:
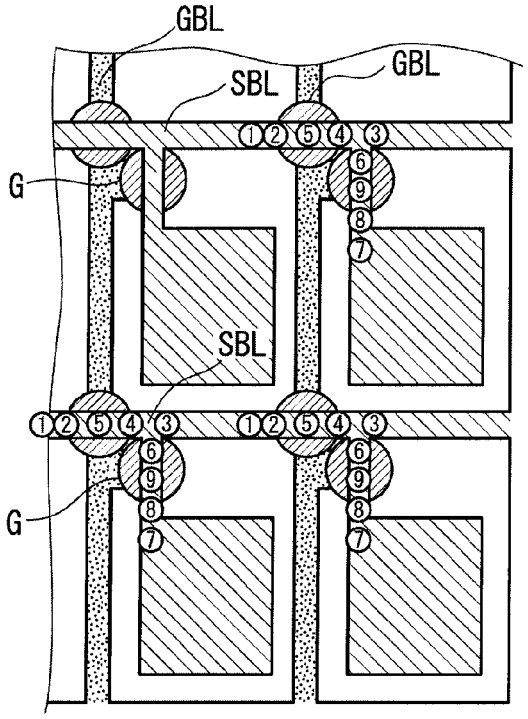
FIG. 20 is a diagram illustrating a process of cutting a wiring of the film substrate (sheet substrate) according to the embodiment.

After the gate-insulating layer I is formed, the film substrate FB is conveyed to the −Z side of the liquid droplet-coating apparatus 120SD. In the liquid droplet-coating apparatus 120SD, the source-drain-forming area 53 of the film substrate FB is coated with metal ink. To a portion of the source-drain-forming area 53 that exceeds the gate-insulating layer I, for example, metal ink is discharged, for example, in the order of 1 to 9 shown in FIG. 20.

After the discharge of the metal ink, the film substrate FB is conveyed to the −Z side of the heat treatment apparatus BK, and a drying process for the metal ink is performed. After the drying process is performed, conductive bodies contained in the metal ink are laminated in a thin film state, whereby the source bus line SBL, the source electrode S, the drain electrode D, and the anode P are formed. In this step, a state is formed in which the source electrode S and the drain electrode D are connected to each other.

Figure 21:
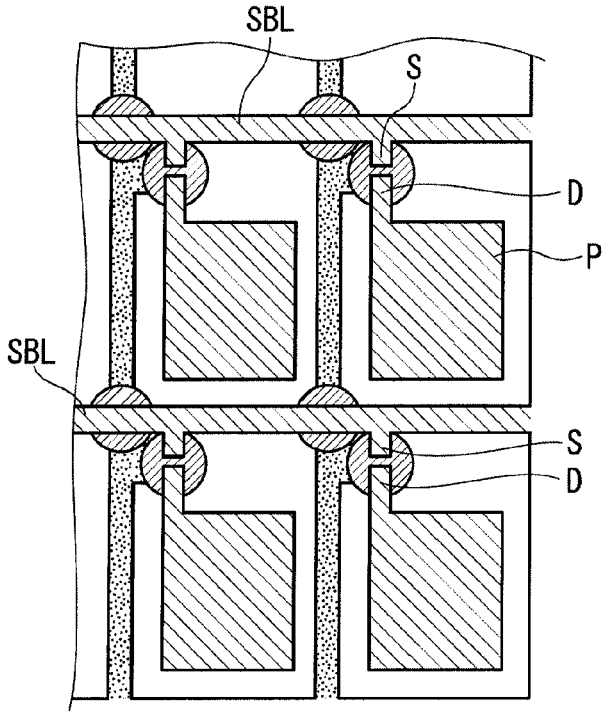
FIG. 21 is a diagram illustrating a process of forming a thin film in a source-drain-forming region according to the embodiment.

Next, the film substrate FB is conveyed to the −Z side of the cutting apparatus 130. The film substrate FB is cut by the cutting apparatus 130 between the source electrode S and the drain electrode D. FIG. 21 is a diagram illustrating a state in which a gap between the source electrode S and the drain electrode D is cut off by the cutting apparatus 130. In the cutting apparatus 130, cutting is performed while adjusting the emission position of the laser light LL on the film substrate FB by using the galvanometer mirror 131.

After cutting between the source electrode S and the drain electrode D is performed, the film substrate FB is conveyed to the −Z side of the liquid droplet-coating apparatus 120OS. An organic semiconductor layer OS is formed on the film substrate FB by the liquid droplet-coating apparatus 120OS. Organic semiconductor ink is discharged to an area located on the film substrate FB that overlaps the gate electrode G over the source electrode S and the drain electrode D.

Figure 22:
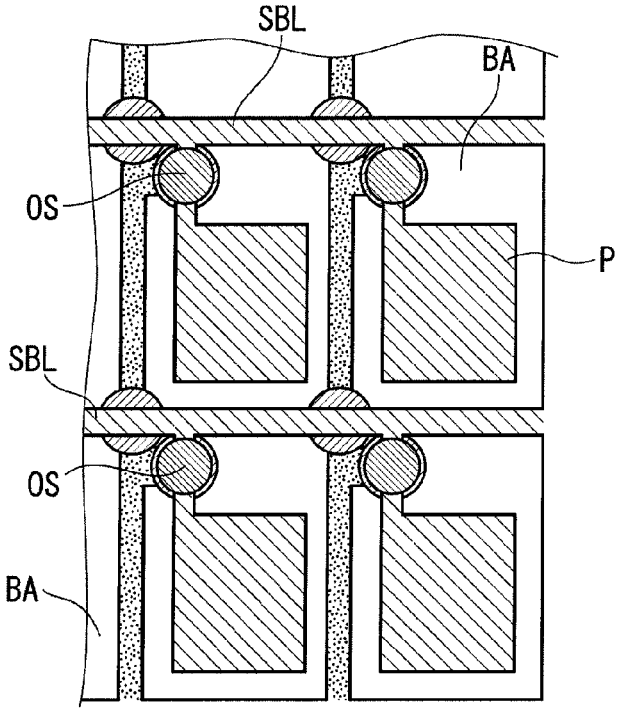
FIG. 22 is a diagram illustrating a process of forming an organic semiconductor layer according to the embodiment.

After the discharge of the organic semiconductor ink, the film substrate FB is conveyed to the −Z side of the thermal treatment apparatus BK, and a drying process is performed for the organic semiconductor ink. After the drying process, a semiconductor contained in the organic semiconductor ink is laminated in a thin film state, and, as illustrated in FIG. 22, an organic semiconductor OS is formed. According to the above-described process, field-effect transistors and connection wirings are formed on the film substrate FB.

Subsequently, the film substrate FB is conveyed to the light-emitting layer-forming portion 93 by the conveying roller RR (see FIG. 8). In the light-emitting layer-forming portion 93, light-emitting layers IR of red, green, and blue are formed by the liquid droplet-coating apparatus 140Re, the liquid droplet-coating apparatus 140Gr, and the liquid droplet-coating apparatus 140B1 and the thermal treatment apparatus BK. Since the partition walls BA are formed on the film substrate FB, even in a case where the light-emitting layers IR of red, green, and blue are continuously coated without performing a thermal treatment by using the thermal treatment apparatus BK, there is no occurrence of a mixed color due to overflowing of solutions into adjacent pixel areas.

After the formation of the light-emitting layers IR, an insulating layer I is formed in the film substrate FB through the liquid droplet-coating apparatus 140I and the thermal treatment apparatus BK, and a transparent electrode ITO is formed through the liquid droplet-coating apparatus 140IT and the thermal treatment apparatus BK. Through such a process, the organic EL element 50 illustrated in FIG. 1 is formed on the film substrate FB.

Figure 23:
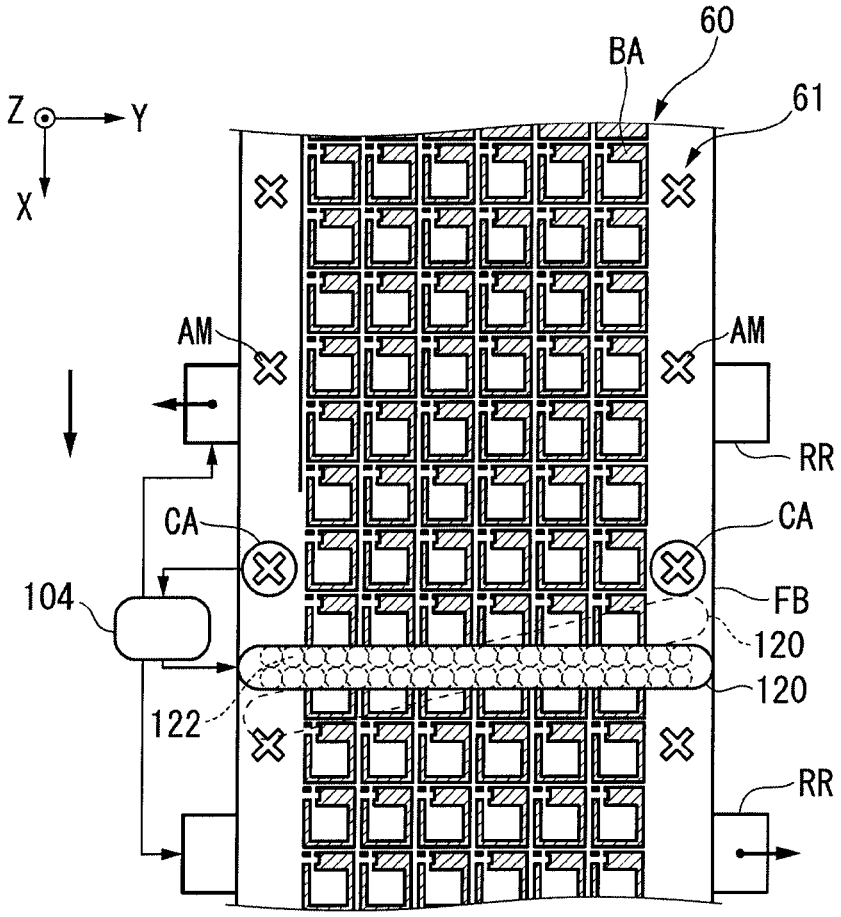
FIG. 23 is a diagram illustrating an example of alignment according to the embodiment.

In the element-forming operation, in the process of forming the organic EL element 50 while conveying the film substrate FB as above, in order to prevent the occurrence of deviations of the film substrate FB in the X direction, the Y direction, and the θZ direction, an alignment operation is performed. Hereinafter, the alignment operation will be described with reference to FIG. 23.

In the alignment operation, a plurality of alignment cameras CA (CA1 to CA8) disposed in each portion appropriately detects the alignment marks AM formed on the film substrate FB and transmits the detection results to the control section 104. The control section 104 performs the alignment operation based on the transmitted detection results.

For example, the control section 104 detects the transfer speed of the film substrate FB based on the imaging intervals of the alignment marks AM detected by the alignment cameras CA (CA1 to CA8) and the like and determines whether the roller RR is rotated, for example, at a predetermined speed. In a case where it is determined that the roller RR does not rotate at the predetermined speed, the control section 104 applies feedback by issuing an instruction for adjustment of the rotation speed of the roller RR.

In addition, for example, the control section 104 detects whether or not there is a positional deviation of the alignments AM in the Y axis direction based on the imaging results of the alignment marks AM and detects whether or not there is the positional deviation of the film substrate FB in the Y axis direction. In a case where the positional deviation is detected, the control section 104 detects whether or not the positional deviation is continued for some degree of time in the state in which the film substrate FB is conveyed.

When a case where the time during which the positional deviation occurred was a short time, it is corresponded by changing a nozzle 122, which performs coating of liquid droplets, out of a plurality of nozzles 122 of the liquid droplet-coating apparatus 120. In a case where the deviation of the film substrate FB in the Y axis direction is continued for a long time, the position of the film substrate FB in the Y axis direction is corrected by moving the roller RR.

In addition, for example, the control section 104 detects whether or not there is a deviation of the film substrate FB in the θZ direction based on the positions of the alignment marks AM, which are detected by the alignment cameras CA, in the X axis and Y axis directions. In a case where a positional deviation is detected, the control section 104, similarly to a case where a positional deviation in the Y axis direction is detected, detects how long the positional deviation has continued in the state in which the film substrate FB is conveyed.

When a case where the time during which the positional deviation occurred was a short time, it is corresponded by changing a nozzle 122, which performs coating of liquid droplets, out of a plurality of nozzles 122 of the liquid droplet-coating apparatus 120. In a case where the deviation is continued for a long time, the position of the film substrate FB in the θZ direction is corrected by moving two rollers RR, which are disposed at positions with the alignment camera CA that has detected the deviation interposed therebetween, in the X direction or the Y direction.

Next, the detachment operation will be described. For example, after the organic EL element 50 is formed on the film substrate FB, and the film substrate FB is recovered, the substrate cartridge 1 used as the substrate-supplying unit 101 is detached from the substrate-processing unit 102.

Figure 24:
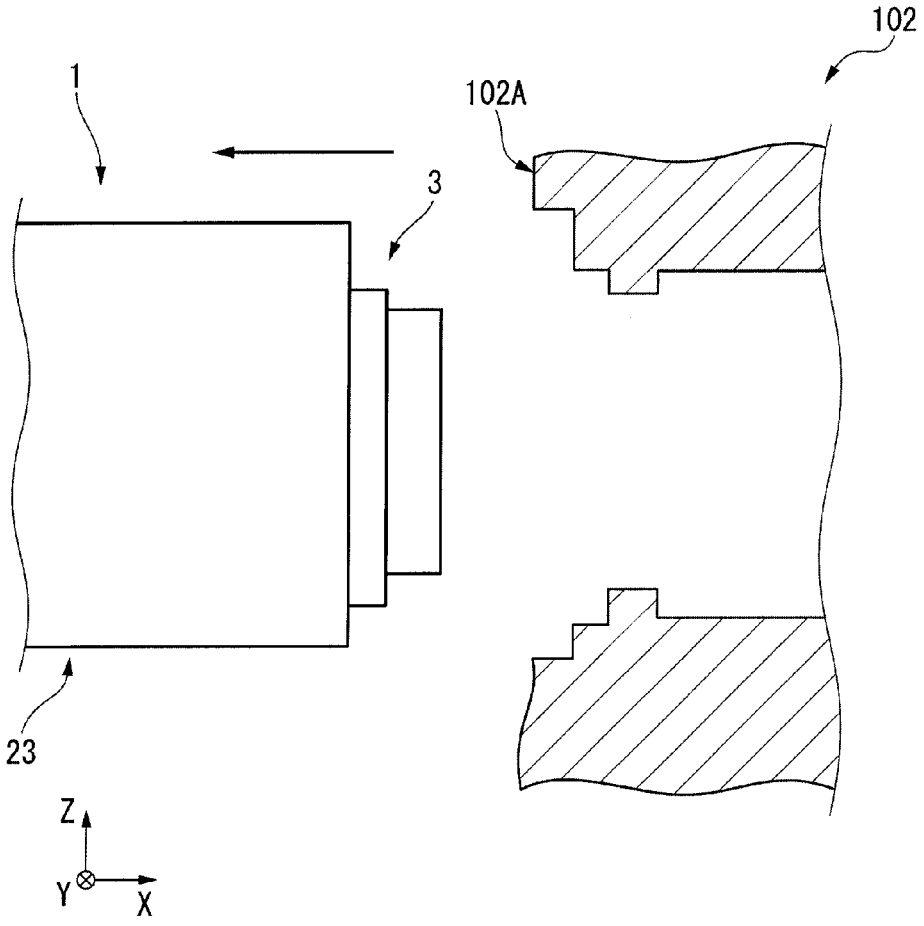
FIG. 24 is a diagram illustrating an operation of detaching the substrate cartridge according to the embodiment.

FIG. 24 is a diagram illustrating the operation of detaching the substrate cartridge 1.

In the detachment operation, the mounting unit 3 is moved in the −X direction so as to be excluded from the supply-side connection portion 102A. The mounting unit 3 is excluded.

As above, since the leader member LDR according to this embodiment includes the connection portion (stair portion 201) that is connected to the film F having flexibility and the position reference portions 202 used for position alignment at least with the film F and the connection portion (stair portion 201), the leader member LDR can be connected to a desired position of the film F with high precision.

In addition, since the film substrate FB according to this embodiment has flexibility and includes the film F conveyed in a predetermined direction and the leader member LDR according to this embodiment that is connected to the end portion of the film F, the end portion of the film F is precisely protected. Accordingly, the deformation of the film F such as bending or distortion, which is generated due to the conveyance of the film substrate FB, can be decreased.

In addition, since the substrate cartridge 1 according to this embodiment includes the cartridge main body 2 that houses the film substrate FB, the film substrate FB can be housed in a state in which bending, distortion, or the like hardly occurs. Furthermore, since the substrate cartridge 1 according to this embodiment includes the cartridge main body 2 that houses the film substrate FB, the housed film can be sent out in a state in which bending, distortion, or the like hardly occurs.

Furthermore, the substrate-processing apparatus 100 according to this embodiment includes the substrate-processing unit 102 that processes the film substrate FB, the substrate-supplying unit 101 that carries in the substrate-processing unit 102, and the substrate-recovering unit 103 that carries out the film substrate FB from the substrate-processing unit 102, and the substrate cartridge 1 according to this embodiment is used as at least one of the substrate-supplying unit 101 and the substrate-recovering unit 103, whereby the film substrate FB that is supplied in the state in which bending, distortion, or the like hardly occurs can be processed, and the film substrate after processing can be housed.

In addition, the leader-connecting method according to this embodiment is a leader-connecting method for connecting the leader member LDR to the film F having flexibility and includes position alignment with the film F and the leader member LDR and connecting the film F and the leader member LDR after the position alignment with the film F and the leader member LDR, whereby the leader member LDR can be connected to a desired position of the film F with high precision.

The technical scope of the present invention is not limited to the above-described embodiments, and appropriates change may be made thereto in the range not departing from the concept of the present invention.

In the above-described embodiment, regarding the size of the leader member LDR, for example, the size of the leader member LDR in the X direction can be set to be longer than the gap between rollers RR that are adjacent in the conveying direction (X direction) out of the rollers RR disposed in the substrate-processing unit 102. Accordingly, the leader member LDR is conveyed in the state of being supported by at least two or more rollers RR, whereby the leader member LDR can be conveyed more reliably.

Figure 25:
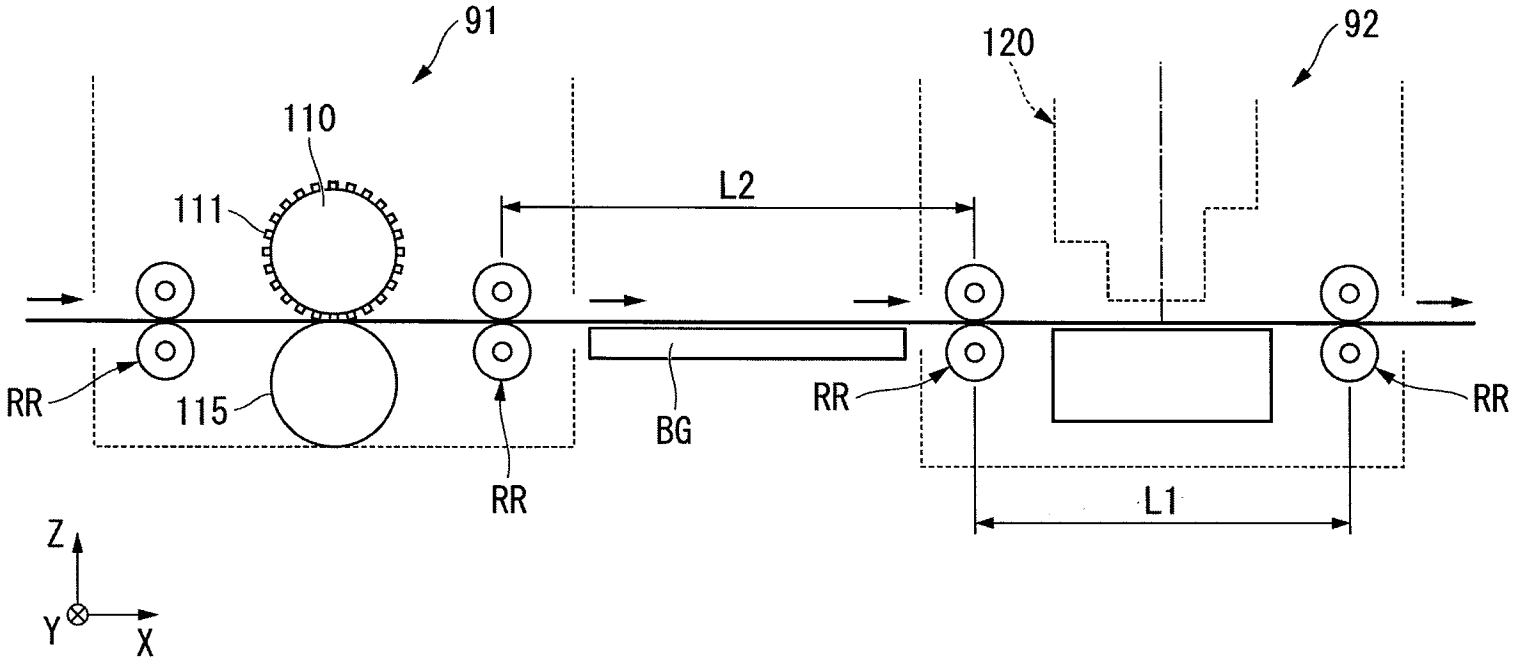
FIG. 25 is a diagram illustrating the configuration of another substrate-processing apparatus according to the embodiment.

In particular, as illustrated in FIG. 25, a configuration may be employed in which the leader member is formed so as to have a length equal to or more than a gap L1 between the entrance-side roller RR and the exit-side roller RR in each processing portion such as the partition wall-forming portion 91 or the electrode-forming portion 92 of the substrate-processing unit 102. In addition, as illustrated in FIG. 25, the leader member may be formed to have a length that is equal to or larger than a gap L2 between the exit-side roller RR of each processing portion such as the partition wall-forming portion 91 or the electrode-forming portion 92 and the roller located on the entrance side of the next processing portion. Furthermore, since the film substrate FB has rigidity at least equal to or larger than that of the film F, the gap L1 between the entrance-side roller and the exit-side roller RR in each processing portion or the gap L2 between the exit-side roller RR of each processing portion and the entrance-side of the next processing portion, for example, can be formed to be longer than that of a case where, for example, there is no leader member LDR. In addition, although the length of the leader member LDR according to this embodiment in the conveying direction is not particularly limited, for example, it may be set to 30 cm or more with the length of the liquid droplet-coating apparatus 120 in the conveying direction, the gap of the processing portions in the conveying direction, and the width of the exposure field in the conveying direction, and the like being taken into account.

In addition, as illustrated in FIG. 25, for example, in a case where the partition wall-forming portion 91 and the electrode-forming portion 92 described above are housed as different apparatuses, and the substrate-processing unit 102 is assembled by connecting the partition wall-forming portion 91 and the electrode-forming portion 92 to each other, a bridge guide BG as an auxiliary portion may be included between the partition wall-forming portion 91 and the electrode-forming portion 92 in the substrate-processing apparatus 100. In addition, for example, in this embodiment, it is preferable that the arrangement height (the height in the Z direction) of the roller RR disposed on the exit-side of each processing portion and the arrangement height of the roller RR disposed on the entrance side of the next processing section be the same or as similar as possible and be about 50 cm to 100 cm from the viewpoint of the operability or the visibility. Furthermore, in a case where the arrangement height of the roller RR disposed on the exit side of each processing portion and the arrangement height of the roller RR disposed on the entrance side of the next processing portion are different from each other, the above-described bridge guide BG may be arranged so as to be tilted in the height direction (Z direction).

Figure 26:
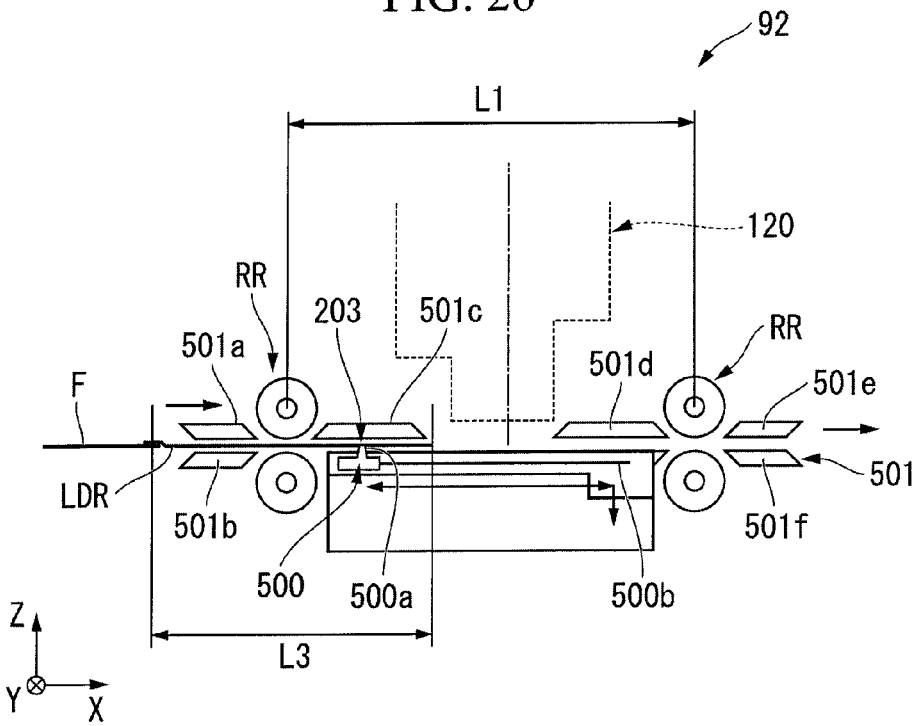
FIG. 26 is a diagram illustrating the configuration of another substrate-processing apparatus according to the embodiment.

In addition, for example, in a case where the size L3 of the leader member LDR in the X direction is smaller than the gap L1 between the entrance-side roller RR and the exit-side roller RR in each processing portion such as the partition wall-forming portion 91 or the electrode-forming portion 92 of the substrate-processing unit 102, as illustrated in FIG. 26, as an auxiliary portion, a slide claw mechanism 500, a guide plate 501, or the like may be configured to be arranged. The slide claw mechanism 500 has a configuration in which a claw member 500*a* having a protruded portion that can be inserted into the opening portion 203 of the leader member LDR can be moved in the X direction along the guide rail 500*b*. In addition, the claw member 500*a* can be moved in the −Z direction at the end portion of the downstream side in the conveying direction so as to extract the inserted protrusion. In addition, as the guide plates 501, for example, as illustrated in FIG. 26, two guide plates (guide plates 501*a* and 502*b*) are disposed on the upstream side of each processing portion (here, for example, the electrode-forming portion 92), one guide plate (the guide plates 501*c* and 501*d*) for each of both end portions in the X direction in the figure inside the electrode-forming portion 92, and two guide plates (the guide plates 501*e* and 501*f*) are disposed on the downstream side of the electrode-forming portion 92.

Figure 27:
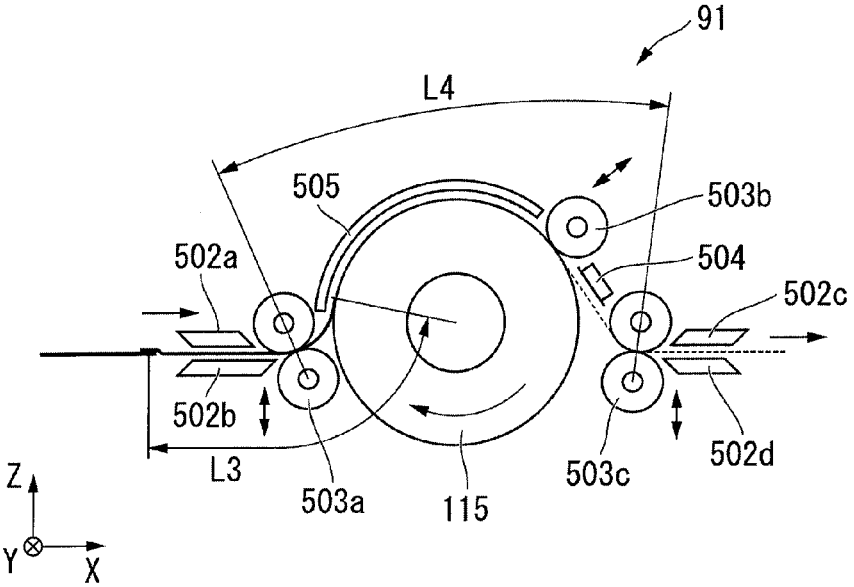
FIG. 27 is a diagram illustrating the configuration of another substrate-processing apparatus according to the embodiment.

In addition, as illustrated in FIG. 27, for example, in a case where the partition wall-forming portion 91 has a configuration in which tension is applied to the film substrate FB on the +Z side by the thermal transfer roller 115, when the size L3 of the leader member LDR in the X direction is smaller than the distance L4 between the rollers RR through the outer face of the thermal transfer roller 115, as an auxiliary portion, a guide plate 502, a loading roller 503, a Bernoulli pad 504, a cover member 505, or the like may be arranged.

Furthermore, as illustrated in FIG. 27, as loading rollers 503, for example, there are a loading roller 503*a* that is disposed so as to be capable to access the roller RR disposed on the upstream side of the thermal transfer roller 115, a loading roller 503*b* that is disposed so as to be capable to access the thermal transfer roller 115, a loading roller 503*c* disposed so as to be capable to access the roller RR disposed on the downstream side of the thermal transfer roller 115, and the like.

The Bernoulli pad 504, for example, includes a Bernoulli mechanism that generates negative pressure in accordance with the movement of the film substrate FB, and makes the film substrate FB to approach the Bernoulli pad 504 side. Since the negative pressure generating face of the Bernoulli pad 504 is disposed along the moving direction of the film substrate FB, the film substrate FB is prevented from being wound into the thermal transfer roller 115.

For example, the cover member 505 is disposed so as to vacate an area brought into contact with the fine imprint mold 111 out of the thermal transfer roller 115 and cover both end portions of the film substrate FB in the X direction. Accordingly, the film substrate FB is moved along the outer face of the thermal transfer roller 115.

Figure 28:
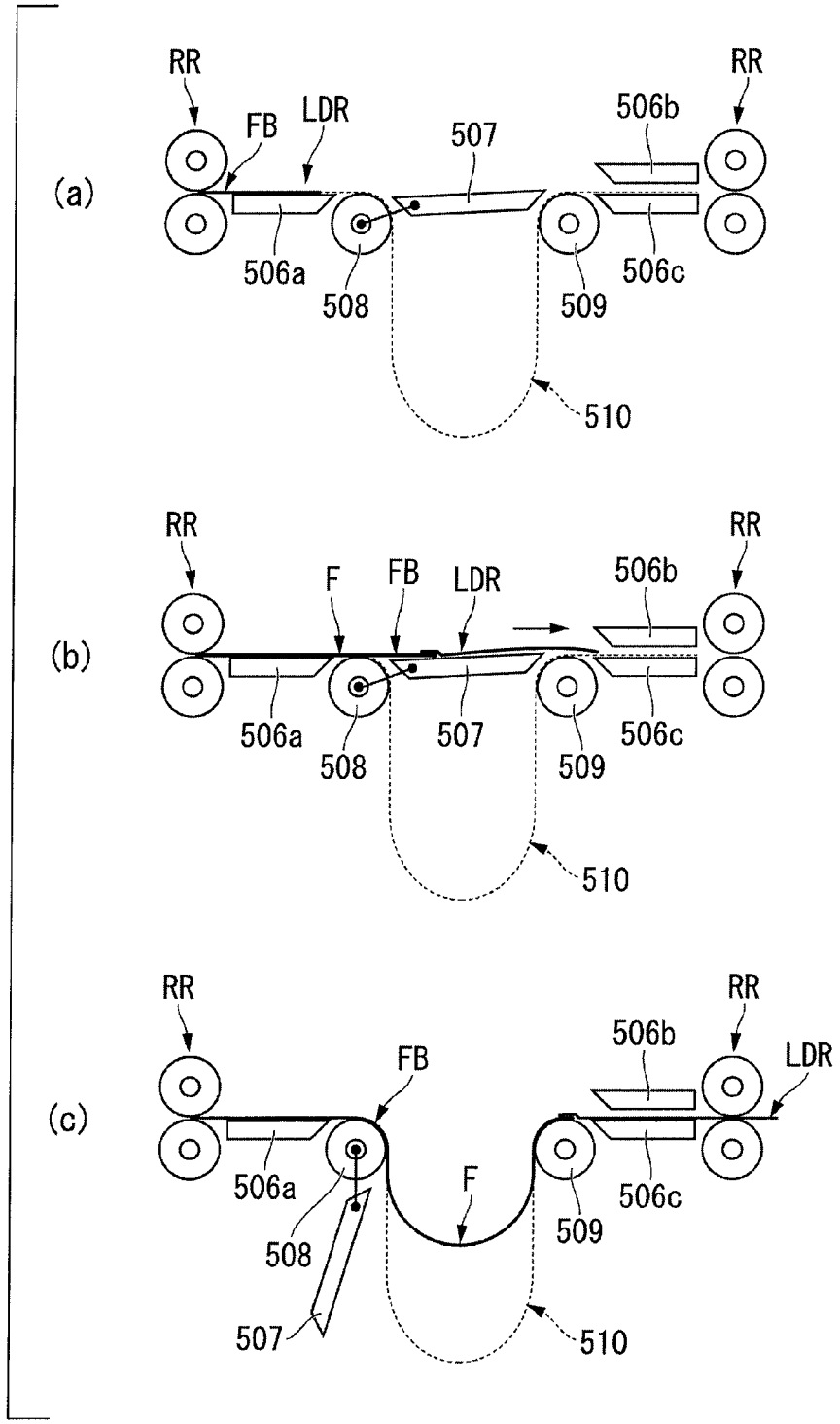
FIG. 28 is a diagram illustrating the configuration of another substrate-processing apparatus according to the embodiment.

In addition, for example, although in the above-described embodiment, a configuration has been described in which the substrate is conveyed in the state in which tension is applied to the film substrate FB inside the substrate-processing unit 102, the present invention is not limited thereto, and, for example, as illustrated in FIGS. 28(*a*) to 28(*c*), the film substrate FB may be configured such that the film substrate FB is bent. In such a case, for example, as illustrated in FIG. 28(*a*), a guide plate 506*a* and an upstream-side roller 508 are arranged on the upstream side of a bank portion 510 that causes the film substrate FB to bend, and a downstream-side roller 509 and guide plates 506*b* and 506*c* are arranged on the downstream side of the bank portion 510. The bridge plate 507, for example, is a plate member that sends out the film substrate FB between the upstream-side roller 508 and the downstream-side roller 509.

In the bank portion 510, first, as illustrated in FIGS. 28(*a*) and 28(*b*), the leader member LDR located at the tip end of the film substrate FB is conveyed through the bridge plate 507 as an auxiliary portion from the upstream side to the downstream side of the bank portion 510. After the leader member LDR, for example, is supported by the downstream-side roller RR of the bank portion 510, as illustrated in FIG. 28(*c*), the bridge plate 507 is released. By releasing the bridge plate 507, an area between the upstream-side roller 508 and the downstream-side roller 509 is not supported, and accordingly, the film F of the film substrate FB conveyed thereafter is bent in accordance with the shape of the bank portion 510. As above, it can be configured such that the leader member LDR is not bent, but the film is bent in the bank portion 510.

In addition, in the above-described embodiment, although a configuration has been described as an example, in which a mark or the like is formed as the position reference portion 202 of the leader member LDR, the present invention is not limited thereto. For example, as illustrated in FIG. 29, it may be configured such that notched portions 520 and 530 are formed in a part of the leader member LDR, and position alignment with the leader member LDR and the film F is performed by using the notched portions 520 and 530.

Figure 29:
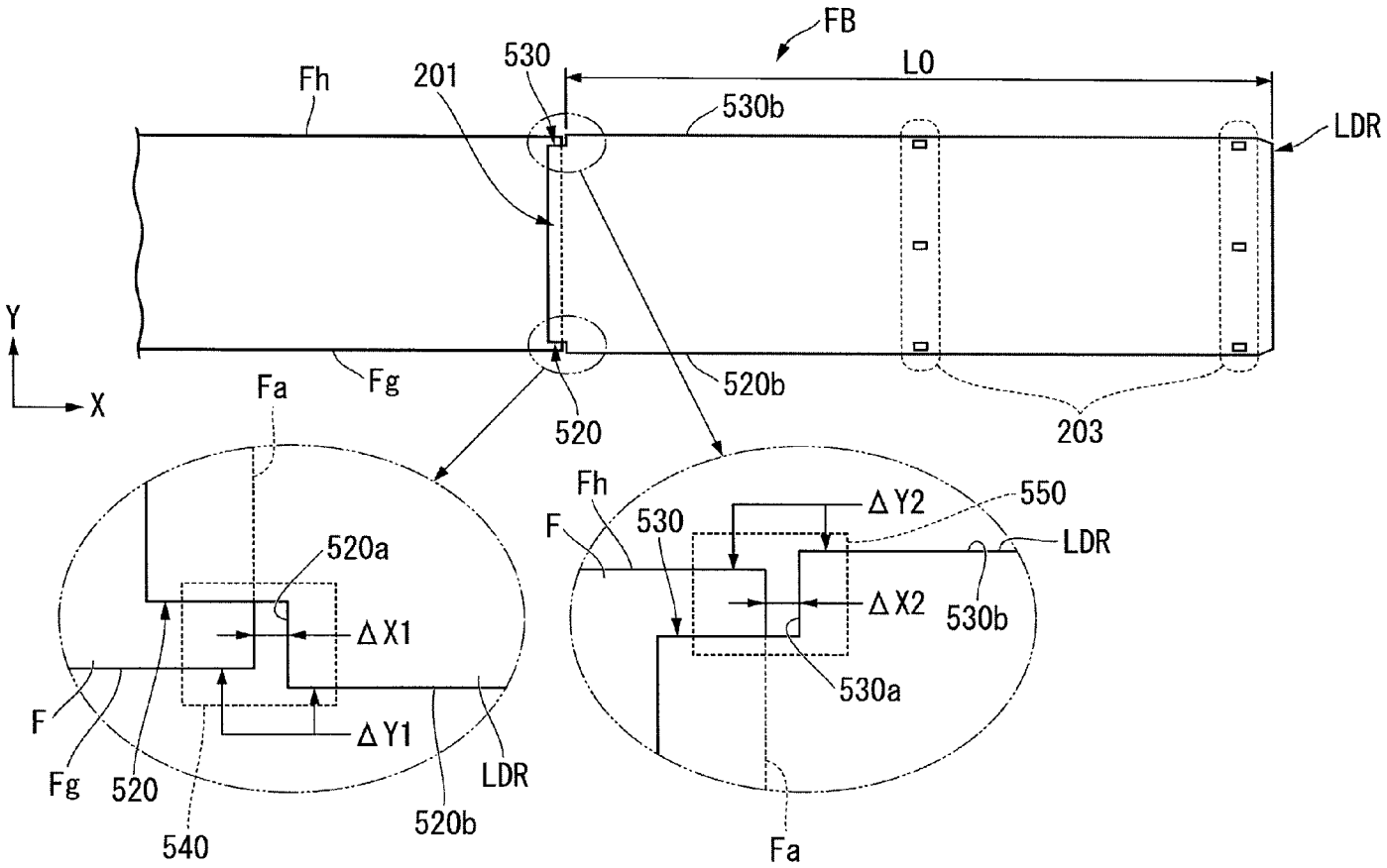
FIG. 29 is a diagram illustrating the configuration of another film substrate according to the embodiment.

In the example illustrated in FIG. 29, the notched portions 520 and 530 are disposed at both end portions (corners) of the connection portion (stair portion 201), which is used for a connection with the film F, in the Y direction. For example, the notched portions 520 and 530 are formed so as to be disposed inside imaging areas 540 and 550 of a CCD camera or the like. The notched portions 520 and 530, as illustrated in an enlarged portion illustrated in FIG. 29, have sides 520*a* and 530*a* that are parallel to the X direction in the figure.

In a case where the position alignment is performed by using the notched portions 520 and 530, first, the leader member LDR is arranged such that the notched portions 520 and 530 and the film F partially overlap each other. Thereon, for example, for the sides 520*a* and 530*a*, distances ΔX1 and ΔX2 that are distances from the corner side Fa of the film F are acquired. In addition, for the side 520*b* of the leader member LDR located on the −Y side and the side 530*b* thereof located on the +Y side, distances ΔY1 and ΔY2 that are distances from the side Fg of the film F, which is located on the −Y side, and the side Fh, which is located on the +Y side, are respectively acquired. Thereafter, for example, the attachment position of the leader member LDR is adjusted such that ΔX1=ΔX2 and ΔY1=ΔY2. According to this configuration, position alignment can be performed without forming any additional mark on the film F side.

What is claimed is:

1. A substrate having a band-shape and flexibility in order to form an electric circuit, the substrate comprising:

a flexible substrate main body having a fixed size in a shorter side direction of the band-shape and having a predetermined length in a longitudinal direction of the band-shape, the electric circuit being formed on a surface of the substrate main body; and a leader member that has a width corresponding to the size of the substrate main body in the shorter side direction and that is configured to be connected to an end portion of the substrate main body in the longitudinal direction, the leader member including a position reference providing an alignment reference with the substrate main body.

2. The substrate according to claim 1, wherein the substrate main body comprises a substrate-side reference portion corresponding to the position reference portion of the leader member.

3. The substrate according to claim 1, wherein the leader member has rigidity higher than that of the substrate main body.

4. The substrate according to claim 1, wherein the substrate main body and the leader member are the same size in a direction perpendicular to a conveying direction of the substrate main body.

5. The substrate according to claim 1, wherein the leader member comprises a notched portion as the position reference portion, and wherein the substrate main body overlaps at least a part of the notched portion.

6. The substrate according to claim 1, wherein the leader member comprises a stair portion in the connection portion, and wherein the substrate main body is connected to the stair portion.

7. The substrate according to claim 6, wherein the stair portion is formed so that one face of the leader member and one face of the substrate main body are in a flush state.

8. A substrate cartridge housing the substrate according to claim 1, the substrate cartridge comprising:

a shaft member that is rotatable by a driving mechanism in order to wind up the substrate in a roll shape in the longitudinal direction, a protruded portion that is disposed so as to protrude from an outer face of the shaft member and that is configured to engage with an opening formed at a part of the leader member of the substrate, a housing portion that is configured to house the substrate wound around the shaft member in the roll shape and that has an opening for carrying in or carrying out the substrate being formed at the housing portion.

9. The substrate cartridge according to claim 8, wherein the cartridge main body houses the substrate in a wound-up state.

10. The substrate cartridge according to claim 8, further comprising a substrate-driving mechanism that performs at least one of winding-up or sending-out of the substrate.

11. The substrate cartridge according to claim 10, wherein the substrate-driving mechanism comprises a shaft member, in which a protruded portion is disposed, disposed so as to be rotatable, and wherein the leader member comprises an opening portion that hangs on the protruded portion of the shaft member.

12. The substrate cartridge according to claim 8, wherein the protruded portion is disposed so as to be capable of protruding from the opening formed at the outer face of the shaft member and capable of being housed in the opening formed at the outer face of the shaft member.

13. The substrate cartridge according to claim 9, wherein the leader member disposed at a tip end of the substrate is formed to have a size capable of being wound around the shaft member at least one or more revolutions.

14. A substrate-processing apparatus comprising:

a substrate-processing unit that processes a substrate;

a substrate carrying-in unit that carries the substrate in the substrate-processing unit; and a substrate carrying-out unit that carries out the substrate from the substrate-processing unit, the substrate cartridge according to claim 8 is used as at least one of the substrate carrying-in unit and the substrate carrying-out unit.

15. The substrate-processing apparatus according to claim 14, wherein the substrate-processing unit comprises a detection section that detects information of the substrate.

16. A leader-connecting method for connecting a leader member to an end portion of a substrate main body having a band-shape and flexibility on which an electric circuit is formed, the leader-connecting method comprising:

aligning the substrate main body with the leader member by detecting a positional relationship between the substrate main body and the leader member by use of a substrate-side position reference portion which is disposed at a part of the substrate main body and a notched portion which is disposed at a part of the leader member as a position reference portion; and connecting a tip end of the substrate main body and the leader member to each other after aligning the substrate main body with the leader member.

17. The leader-connecting method according to claim 16, wherein the tip end of the substrate main body and an end portion of the leader member are joined together in the connecting of the substrate main body and the leader member.

18. A method of manufacturing a display element that forms a display element comprising a plurality of pixels on the substrate according to claim 1, the method comprising:

conveying the substrate into a substrate-processing apparatus for forming the display element by using the leader member; and forming an electric circuit of the display element at a predetermined forming area on the substrate main body which is relatively aligned with respect to the position reference portion of the leader member, by using the substrate-processing apparatus.

19. The method of manufacturing a display element according to claim 18, wherein the substrate-processing apparatus comprises at least two conveying sections that are configured to convey the substrate, and wherein a length of the leader member in a conveying direction is equal to or more than an arrangement gap between the two conveying sections.

20. The method of manufacturing a display element according to claim 18, wherein the substrate-processing apparatus comprises at least two processing sections that are configured to process the substrate, and wherein a length of the leader member in a conveying direction is equal to or more than the arrangement gap between the two of the processing sections.

21. A method of manufacturing an electronic circuit including a substrate main body having a band-shape and flexibility, the substrate main body being carried into a processing apparatus for manufacturing the electronic circuit, the method of manufacturing an electronic circuit comprising:

connecting a leader member to an end portion of the substrate main body in a longitudinal direction of the substrate main body for a predetermined length, the leader member having a size and a thickness capable of being carried into the processing apparatus similar to the manner the substrate main body is carried into the processing apparatus, and having a sheet-like form and rigidity higher than the substrate main body, carrying a tip end portion of the leader member into the processing apparatus; and setting a guide between a plurality of rollers or in a periphery of the plurality of rollers so that the tip end portion of the leader member is carried outside of the processing apparatus by passing the plurality of rollers provided inside of the processing apparatus.

22. The method of manufacturing an electronic circuit according to claim 21, wherein the leader member includes an information-storage portion which is configured to store information relating to a specification of the substrate main body, machining information with respect to the substrate main body or process information, the information-storage portion being placed at a predetermined position in the leader member, and wherein the processing apparatus is configured to read the information stored in the information-storage portion of the leader member and is configured to use the information for processing the substrate main body.

23. The method of manufacturing an electronic circuit according to claim 22, wherein the processing apparatus includes at least two processing sections that are configured to perform different processes to the substrate main body and that are disposed along the longitudinal direction of the substrate main body, and wherein the predetermined length of the leader member is equal to or more than an arrangement gap between the two of the processing sections.

24. A substrate-processing apparatus for forming an electric circuit on a substrate main body having a band-like shape and flexibility, the substrate-processing apparatus comprising, a plurality of rollers that is configured to convey a substrate in an order of a carrying-in unit, a processing unit and a carrying-out unit along a longitudinal direction of the substrate main body, the substrate including a leader member which has a width corresponding to a width of the substrate main body in a shorter side direction and which is configured to be connected to an end portion of the substrate main body with a predetermined length in the longitudinal direction, and a guide member that is disposed between the plurality of rollers or in a periphery of the plurality of rollers so that a tip end portion of the leader member carried in by the carrying-in unit is carried out from the carrying-out unit.

25. A substrate-processing apparatus for forming an electric circuit on a substrate main body having a band-like shape and flexibility, the substrate-processing apparatus comprising, a plurality of rollers that is configured to convey a substrate in an order of a carrying-in unit, a processing unit and a carrying-out unit along a longitudinal direction of the substrate main body, the substrate including a leader member which has a width corresponding to a width of the substrate main body in a shorter side direction and which is configured to be connected to an end portion of the substrate main body with a predetermined length in the longitudinal direction, and an auxiliary portion that is configured to move a tip end portion of the leader member between the plurality of rollers so that the tip end portion of the leader member carried in by the carrying-in unit is carried out from the carrying-out unit.

26. A method of substrate processing that carries a substrate main body having a band-shape and flexibility into a processing apparatus and that performs a predetermined process to the substrate main body, the method of substrate processing comprising:

connecting a leader member to an end portion of the substrate main body in the longitudinal direction for a predetermined length, the leader member having a size and a thickness capable of being carried into the processing apparatus similar to the manner the substrate main body is carried into the processing apparatus, and having a sheet-like form and rigidity higher than the substrate main body, guiding the tip end portion of the leader member inside of the processing apparatus by use of a guide member that is set between a plurality of rollers provided inside of the substrate-processing apparatus or in a periphery of the plurality of rollers when the tip end portion of the leader member is carried inside of the processing unit, or by use of an auxiliary portion that is configured to move the tip portion of the leader member between the plurality of rollers in the longitudinal direction.

* * * * *